US011804341B2

(12) United States Patent
Liang et al.

(10) Patent No.: US 11,804,341 B2
(45) Date of Patent: Oct. 31, 2023

(54) KEYCAP AND MANUFACTURING METHOD THEREOF AND KEYSWITCH

(71) Applicants: LITE-ON Technology (Chang Zhou) Co., LTD., Jiangsu Province (CN); LITE-ON Technology Corporation, Taipei (TW)

(72) Inventors: XiaoQiang Liang, Jiangsu Province (CN); Wei-Pin Chuang, Taipei (TW); Lei Shi, Jiangsu Province (CN); ZhangDong Tan, Jiangsu Province (CN)

(73) Assignees: LITE-ON Technology (Chang Zhou) Co., LTD., Jiangsu Province (CN); LITE-ON Technology Corporation, Taipei (TW)

( * ) Notice: Subject to any disclaimer, the term of this patent is extended or adjusted under 35 U.S.C. 154(b) by 0 days.

(21) Appl. No.: 17/102,889

(22) Filed: Nov. 24, 2020

(65) Prior Publication Data

US 2021/0398757 A1 Dec. 23, 2021

(30) Foreign Application Priority Data

Jun. 22, 2020 (CN) ..... 202010573982.9

(51) Int. Cl.
*H01H 13/83* (2006.01)
*H01H 13/704* (2006.01)

(52) U.S. Cl.
CPC ..... *H01H 13/704* (2013.01); *H01H 13/83* (2013.01)

(58) Field of Classification Search
CPC ..... H01H 13/83; H01H 2219/062; H01H 13/023; H01H 2219/036; H01H 2219/056;
(Continued)

(56) References Cited

U.S. PATENT DOCUMENTS 10,340,100 B1 * 7/2019 Yang ..... H01H 13/20
2010/0252407 A1 * 10/2010 Merminod ..... H01H 11/00 200/5 A (Continued)

FOREIGN PATENT DOCUMENTS

CN 102496509 A 6/2012
CN 103681063 A 3/2014

(Continued)

*Primary Examiner* — Ahmed M Saeed
(74) *Attorney, Agent, or Firm* — Umberg Zipser LLP

(57) ABSTRACT

The present invention provides a keycap, method for manufacturing a keycap, and keyswitch. The keycap comprises an inner keycap member, an outer keycap member, and a character layer. The inner keycap member comprises an inner body and an inner sidewall. The inner sidewall is disposed on the periphery of the inner body. The outer keycap member is disposed on the inner keycap member. The outer keycap member comprises an outer body and an outer sidewall. The outer sidewall is disposed on the periphery of the outer body. The outer body is corresponding to the inner body. The outer sidewall corresponds to the inner sidewall. The character layer is disposed between the inner keycap member and the outer keycap member. The character layer comprises a character pattern disposed between the outer body and the inner body.

19 Claims, 23 Drawing Sheets

(58) Field of Classification Search
CPC .... H01H 2221/07; H01H 9/161; H01H 9/182; H01H 19/025; H01H 23/025; H01H 13/14; H01H 3/125; H01H 13/7065; H01H 13/704; H01H 13/04; H01H 13/70; H01H 13/20; H01H 13/50; H01H 13/52; H01H 2221/036; H01H 3/12
See application file for complete search history.

(56) References Cited

U.S. PATENT DOCUMENTS

| | | | | |
|---|---|---|---|---|
| 2015/0090571 | A1* | 4/2015 | Leong | H01H 11/00 200/5 A |
| 2016/0049266 | A1* | 2/2016 | Stringer | H01H 13/88 200/5 A |
| 2021/0193411 | A1* | 6/2021 | Lai | H01H 13/86 |

FOREIGN PATENT DOCUMENTS

| | | | |
|---|---|---|---|
| CN | 204011173 | U | 12/2014 |
| CN | 204155814 | U | 2/2015 |
| CN | 106356228 | A | 1/2017 |
| CN | 208352177 | U | 1/2019 |
| CN | 209401538 | U | 9/2019 |

* cited by examiner

KEYCAP AND MANUFACTURING METHOD THEREOF AND KEYSWITCH

CROSS-REFERENCE TO RELATED APPLICATION

This application claims the priority benefit of Chinese Patent Application Serial Number CN 202010573982.9, filed on Jun. 22, 2020, the full disclosure of which is incorporated herein by reference.

BACKGROUND

Technical Field

The present invention relates to the technical field of input devices, particularly to keycap, method for manufacturing a keycap, and keyswitch.

Related Art

Keyswitches of conventional keyboards generally includes a metal base plate, circuit board, elastic pad, supporting component, and keycap. A character layer is often formed on the surface of the keycap body when manufacturing keycap. The character layer is made by spraying a coating on the surface of the keycap body, followed by a baking process. Then, a top paint is sprayed on the coating, followed by a second baking process. Finally, UV paint is sprayed on the top paint, followed by a third baking process. As the production of the character layer is cumbersome, the production efficiency of the keycap is at a low level. In addition, since the character layer is superimposed by three layers of paint, the production yield of keycaps may decrease. When using this type of keycap, the character layer is exposed to the outside to be directly touched by users, which could cause the character layer to be worn easily.

SUMMARY

The embodiments of the present invention provide a keycap, a method for manufacturing a keycap, and a keyswitch to solve the problem of cumbersome production, poor production efficiency, and production yield, and easily worn when using of the character layer of the conventional keycap.

In one aspect, the present invention provides a keycap, comprising an inner keycap member, an outer keycap member, and a character layer. The inner keycap member comprises an inner body and an inner sidewall. The inner sidewall is disposed on the periphery of the inner body. The outer keycap member is disposed on the inner keycap member. The outer keycap member comprises an outer body and an outer sidewall. The outer sidewall is disposed on the periphery of the outer body. The outer body is corresponding to the inner body. The outer sidewall corresponds to the inner sidewall. The character layer is disposed between the inner keycap member and the outer keycap member. The character layer comprises a character pattern disposed between the outer body and the inner body.

In another aspect, the present invention provides a keycap, comprising an inner keycap member and an outer keycap member. The inner keycap member comprises an inner body and four inner sidewalls disposed on four sides of the inner body. Two ends of each of the inner sidewalls are connected to other inner sidewalls. At least one of the four inner sidewalls comprises an inner keycap positioning part. The outer keycap member is disposed on the inner keycap member, comprising an outer body and four outer sidewalls disposed on four sides of the outer body. Two ends of each of the outer sidewalls are connected to other outer sidewalls. The outer body corresponds to the inner body. The four outer sidewalls correspond to the four inner sidewalls, respectively. At least one of the four outer sidewalls comprises an outer keycap positioning par. The outer keycap positioning part is connecting to the inner keycap positioning part. Wherein the inner keycap member or the outer keycap member comprises a character layer. The character layer comprises a character pattern.

In yet another aspect, the present invention provides a method for manufacturing a keycap for manufacturing the keycap according to the first aspect, comprising: providing the inner keycap member and the outer keycap member; forming the character layer on the inner keycap member; and disposing the outer keycap member on the inner keycap member, having the character layer being disposed between the inner keycap member and the outer keycap member.

In yet another aspect, the present invention provides a method for manufacturing a keycap for manufacturing the keycap according to the first aspect, comprising: providing the inner keycap member and the outer keycap member; forming the character layer on an inner surface of the outer keycap member; and disposing the outer keycap member on the inner keycap member, having the character layer being disposed between the inner keycap member and the outer keycap member.

In yet another aspect, the present invention provides a keyswitch, comprising a base plate, a circuit board disposed on the base plate, an elastic member disposed on the circuit board, a keycap, according to the first or the second aspects, disposed on the elastic member, and a supporting component, tow ends of which are respectively connected to the base plate and the keycap.

In the embodiments of the present invention, by disposing the character layer between the inner keycap member and the outer keycap member, a touch of the character layer by users could be avoided to improve wear resistance and reliability of the character layer. In addition, the character layer can be single-layer paint or double-layer paint, which reduces the number of paint layers for the character layer and simplifies the manufacturing process of the character layer. Therefore, the production efficiency and production yield of the keycap can be greatly improved.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
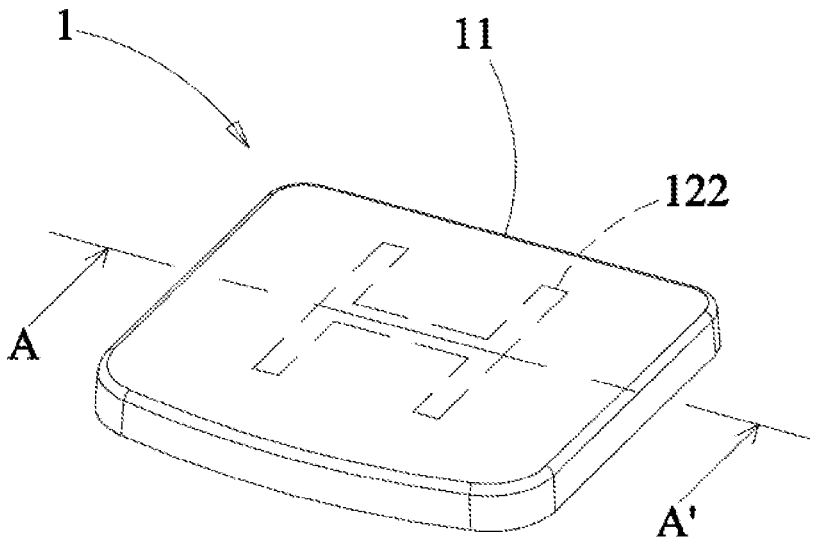
FIG. 1 is a perspective view of a keycap of the first embodiment of the present invention.

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to member a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

In the following embodiment, the same reference numerals are used to refer to the same or similar elements throughout the disclosure.

Figure 2:
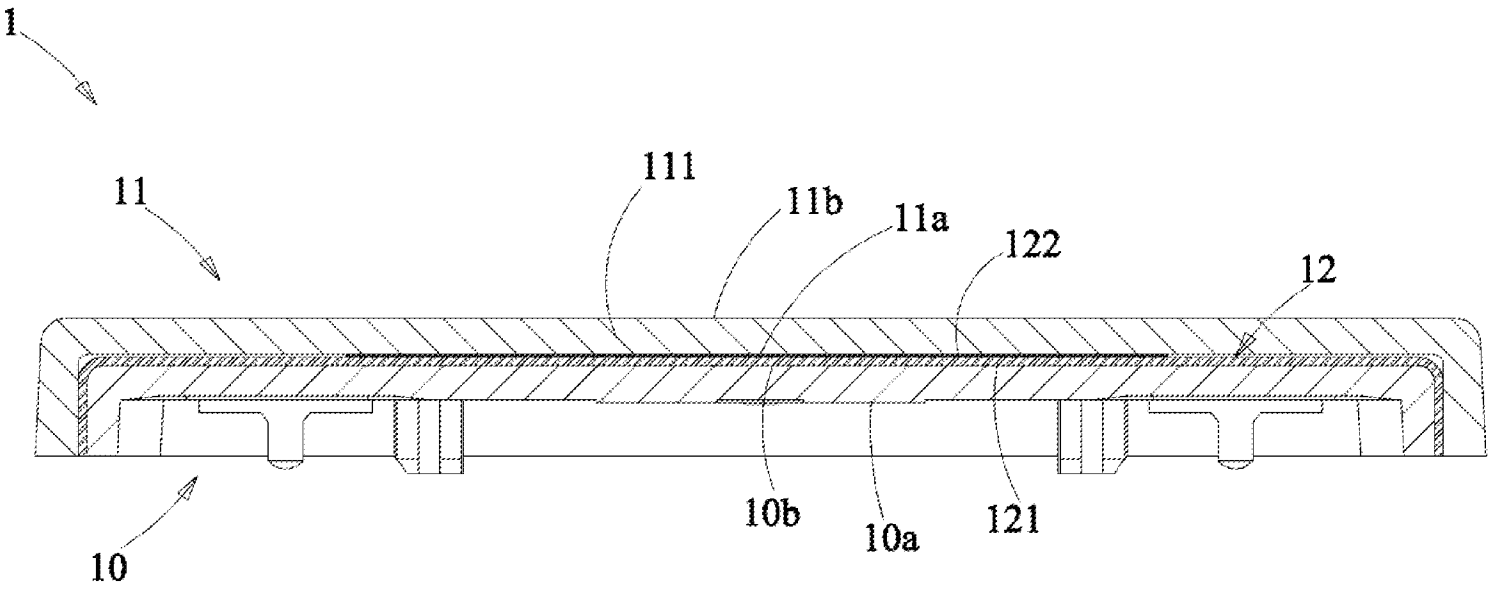
FIG. 2 is a cross-sectional view along line A-A' of FIG. 1.
Figure 3:
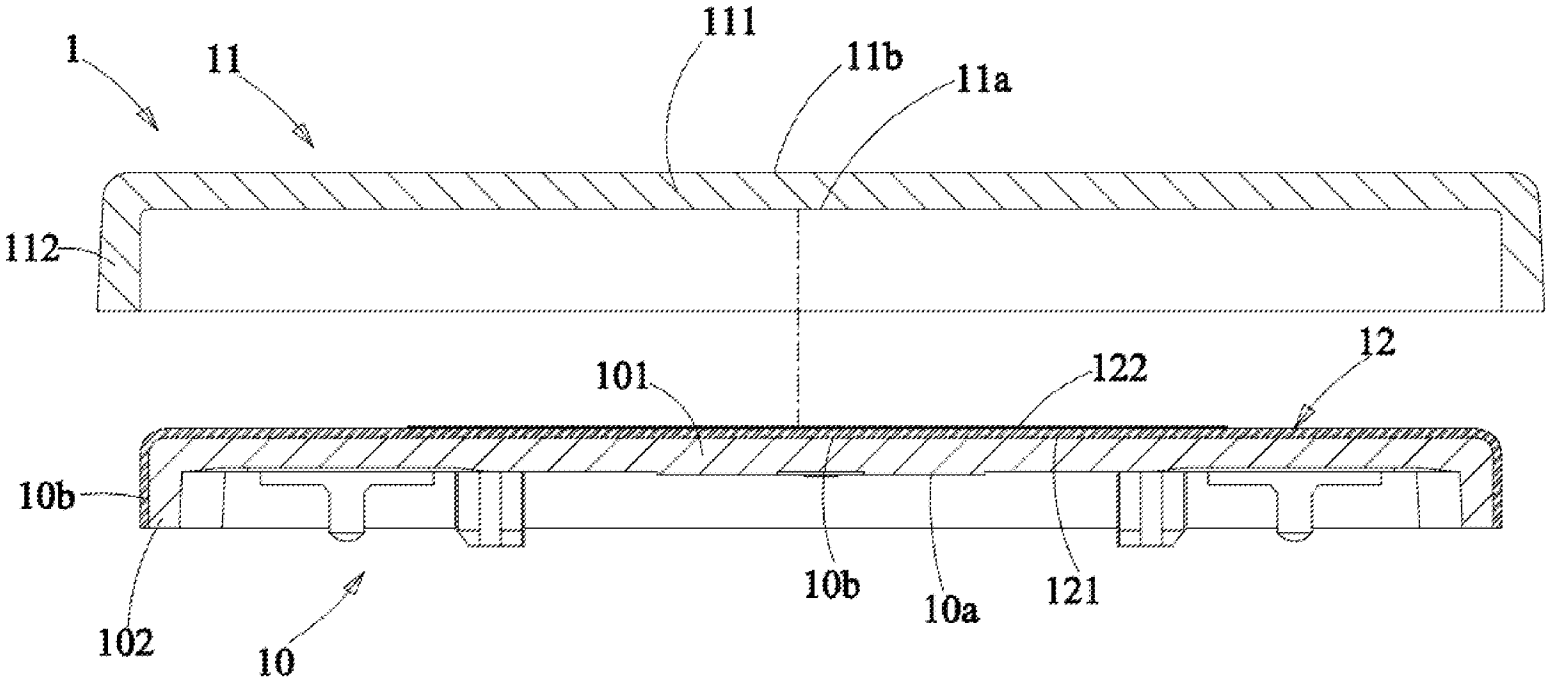
FIG. 3 is an exploded schematic diagram of the keycap of FIG. 2.

FIG. 1 is a perspective view of a keycap of the first embodiment of the present invention. FIG. 2 is a cross-sectional view along line A-A' of FIG. 1. FIG. 3 is an exploded schematic diagram of the keycap of FIG. 2. As shown in the figure, the keycap 1 of this embodiment comprises an inner keycap member 10, an outer keycap member 11, and a character layer 12. The outer keycap member 11 is disposed on the inner keycap member 10. The character layer 12 is disposed between the inner keycap member 10 and the outer keycap member 11. The character layer 12 comprises a character pattern 122.

As shown in FIG. 2 and FIG. 3, the inner keycap member 10 comprises an inner body 101 and an inner sidewall 102, which is disposed on the periphery of the inner body 101 and extends downward from the inner body 101. The outer keycap member 11 comprises an outer body 111 and an outer sidewall 112, which is disposed on the periphery of the outer body 111 and extends downward from the outer body 111. When the outer keycap member 11 is disposed on the inner keycap member 10, the outer body 111 corresponds to the inner body 101, the outer sidewall 112 corresponds to the inner sidewall 102, and the character pattern 122 is disposed between the inner body 101 and the outer body 111. In this embodiment, the character layer 12 is disposed between the inner body 101 and the outer body 111, and between the inner sidewall 102 and the outer sidewall 112. The character layer 12 can also be disposed only between the inner body 101 and the outer body 111. The inner keycap member 10 comprises a first inner surface 10*a* and a first outer surface 10*b* corresponding to the inner keycap member 10. The outer keycap member 11 comprises a second inner surface 11*a* and a second outer surface 11*b* corresponding to the second inner surface 11*a*. In this embodiment, when the outer keycap member 11 is disposed on the inner keycap member 10, the second inner surface 11*a* of the outer keycap member 11 corresponds to the first outer surface 10*b* of the inner keycap member 10, and the character layer 12 is disposed between the first outer surface 10*b* and the second inner surface 11*a*.

In this embodiment, the character layer 12 is, for example, disposed on the first outer surface 10*b* of the inner keycap member 10. The character layer 12 also comprises a shading part 121. The character pattern 122 is disposed on a surface of the shading part 121 close to the outer keycap member 11. The shading part 121 is, for example, covered on the inner body 101 and the inner sidewall 102, and can be used as a base color of the keycap 1. In this embodiment, the inner keycap member 10 and the outer keycap member 11 of the keycap 1 are transparent, and the color of the character layer 12 depends on the desired keyswitch color, such as black, dark colors, white or light colors. In this embodiment, the character layer 12 of the keycap 1 is disposed between the inner keycap member 10 and the outer keycap member 11. In this way, the character layer 12 could be protected by the outer keycap member 11 to keep the character layer 12 from being directly contacting with users, and to effectively improve the wear resistance and reliability of the character layer 12.

Figure 4:
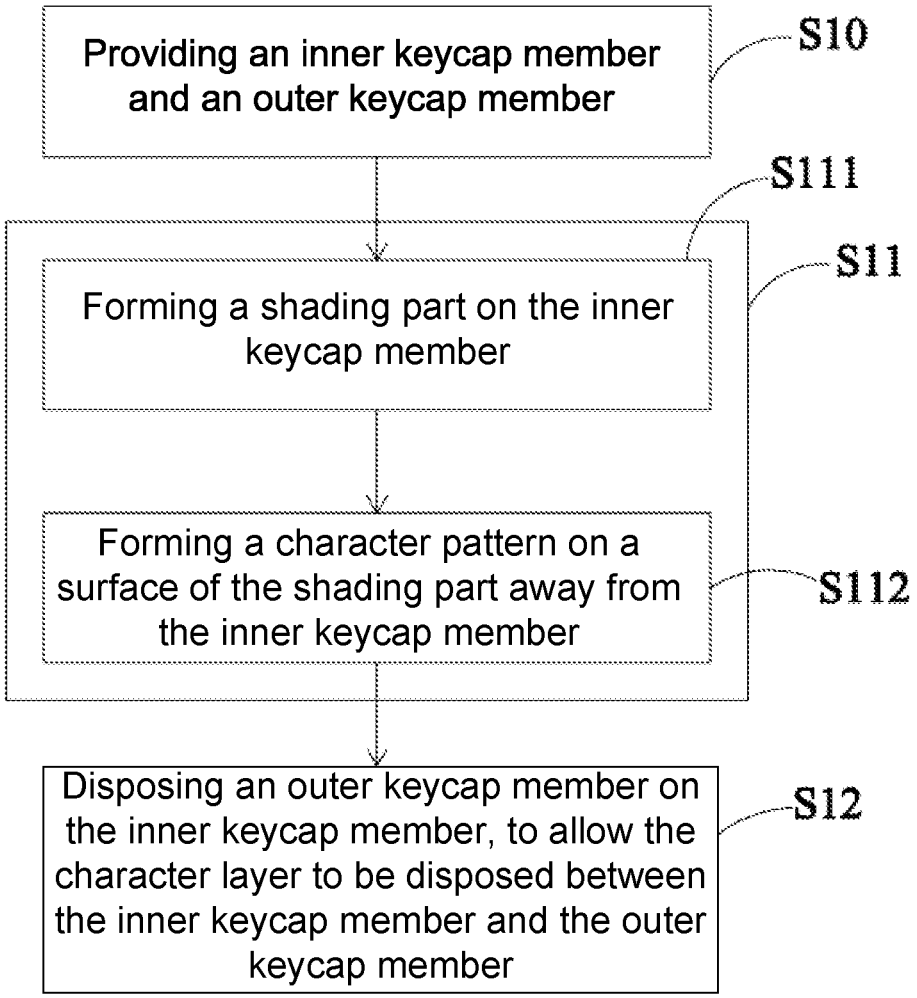
FIG. 4 is a flowchart of the method for manufacturing a keycap of the first embodiment of the present invention.

FIG. 4 is a flowchart of the method for manufacturing a keycap of the first embodiment of the present invention. Referring to FIG. 4 with FIG. 3, in this embodiment, the manufacturing method of the keycap first executes step S10 to provide the inner keycap member 10 and the outer keycap member 11. Then step S11 is performed to form a character layer 12 on the inner keycap member 10, which is, in this embodiment, on a first outer surface 10*b* of the inner keycap member 10. Finally, step S12 is performed to dispose the outer keycap member 11 on the inner keycap member 10 so that the character layer 12 can be disposed between the inner keycap member 10 and the outer keycap member 11. That is, a second inner surface 11*a* of the outer keycap member 11 is disposed on the character layer 12.

In step S11, to form the character layer 12 on the inner keycap member 10, step S111 is first performed to form a shading part 121 on the inner keycap member 10. The shading part 121 can be formed on the first outer surface 10*b* of the inner keycap member 10 by spraying or printing. Then, step S112 is performed to form a character pattern 122 on a surface of the shading part 121 away from the inner keycap member 10. In this embodiment, the character pattern 122 formed on the surface of the shading part 121 is formed by printing or inkjet printing. It can be seen from the above that the character layer 12 is only single-layered sprayed or printed on the shading part 121. Thus, the production of the character layer 12 can be simplified to improve the efficiency and production yield of the keycap 1.

In addition to printing or inkjet printing character patterns 122 on the shading part 121, the character patterns 122 may also be formed by way of forming character grooves on the shading part 121 followed by filling color ink into the character grooves. The character grooves could not penetrate the shading part 121, or the character grooves penetrate the shading part 121 but without penetrating the inner keycap member 10. The character groove is formed by lasering on the shading part 121.

Figure 5:
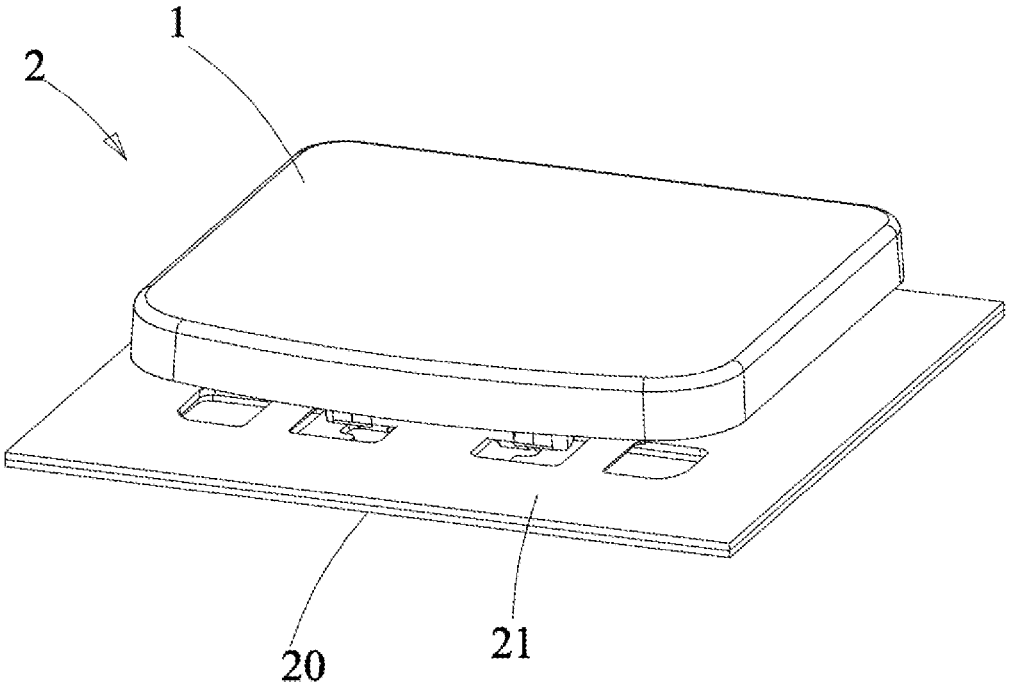
FIG. 5 is a perspective view of a keyswitch of the first embodiment of the present invention.
Figure 6:
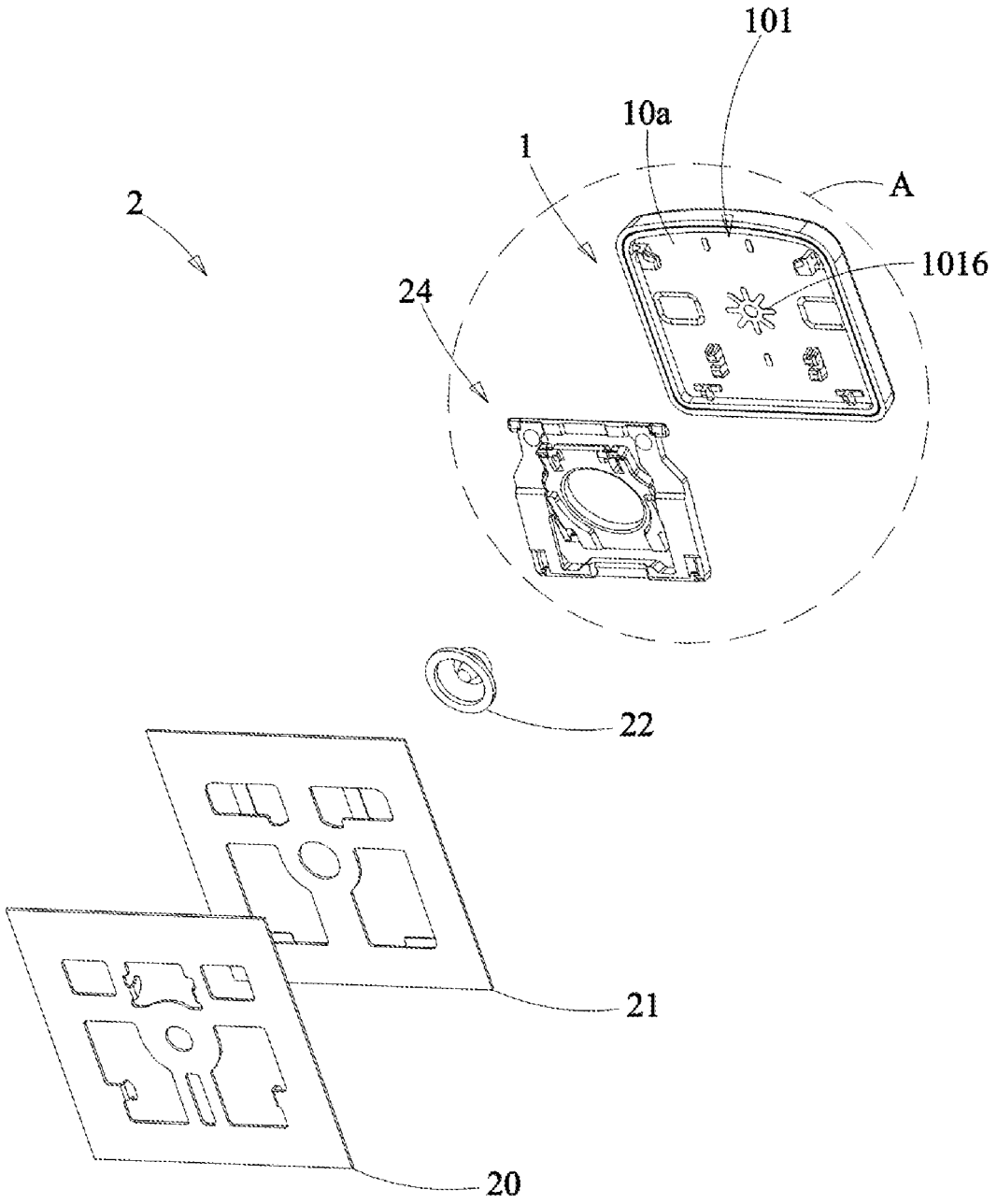
FIG. 6 is an exploded view of a keyswitch of the first embodiment of the present invention.

FIG. 5 is a perspective view of a keyswitch of the first embodiment of the present invention. FIG. 6 is an exploded view of a keyswitch of the first embodiment of the present invention. In this embodiment, a keyswitch 2 comprises a base plate 20, a circuit board 21, an elastic member 22, a keycap 1, and a supporting component 24. The circuit board 21 is disposed on the base plate 20, and the base plate 20 is exposed from the circuit board 21. The elastic member 22 is disposed on the circuit board 21. In this embodiment, the elastic member 22 is disposed on a surface of the circuit board 21 away from the base plate 20. The keycap 1 is disposed on the elastic member 22 and is disposed above the circuit board 21. Two ends of the supporting component 24 are respectively connected to the base plate 20 and the keycap 1. In this embodiment, the elastic member 22 is disposed within the aperture defined by the supporting component 24.

Figure 7:
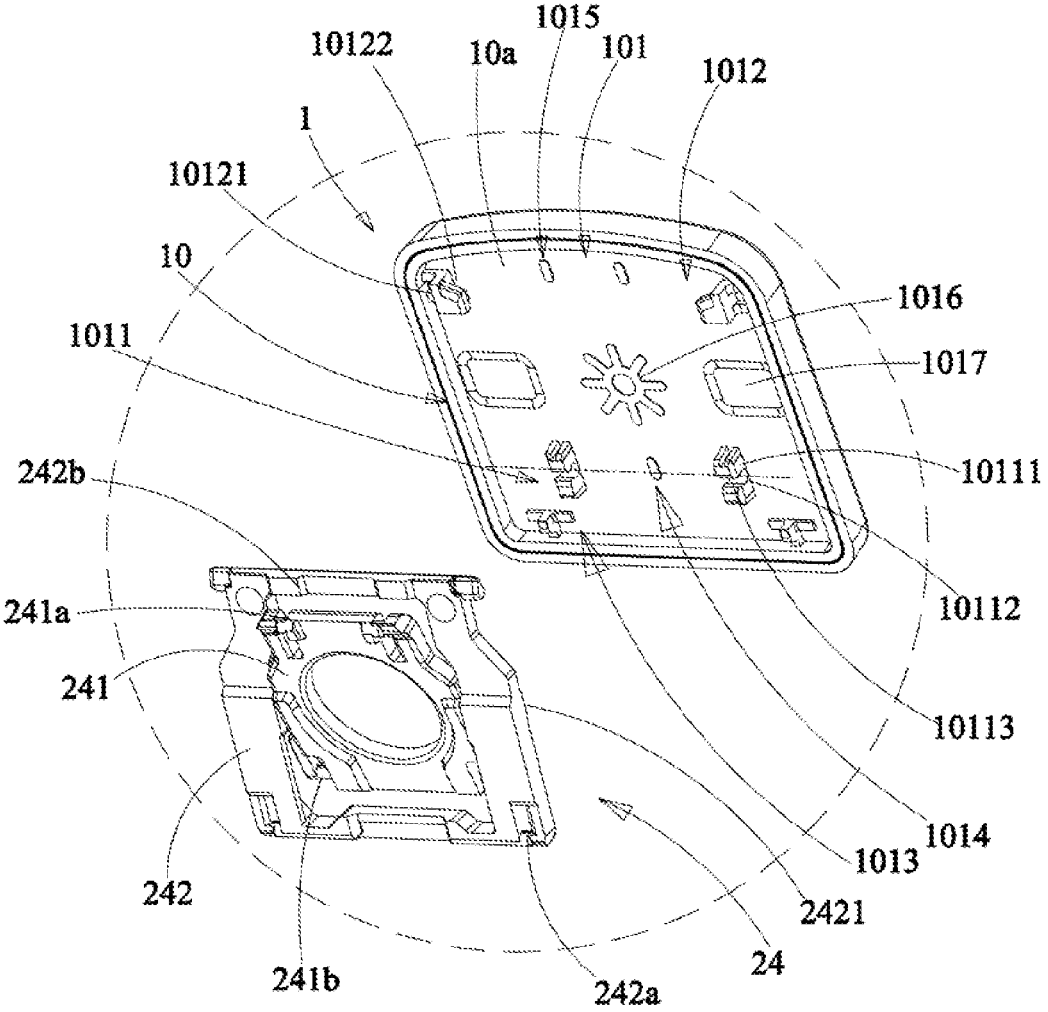
FIG. 7 is an enlarged view of area A of FIG. 6.

FIG. 7 is an enlarged view of area A of FIG. 6. As shown in the figure, the inner body 101 of the inner keycap member 10 of this embodiment comprises a first connecting part 1011 and a second connecting part 1012 opposite to the first connecting part 1011. The first connecting part 1011 and the second connecting part 1012 are disposed on the first inner surface 10*a*. The supporting component 24 is configured as a scissor-shaped mechanism, which comprises an inner member 241 and an outer member 242 in which the inner member 241 is disposed. The center of the inner member 241 is rotatably connected to the center of the outer member 242. The inner member 241 comprises a first inner end 241*a* and a second inner end 241*b*, and the outer member 242 comprises a first outer end 242*a* and a second outer end 242*b*. The first inner end 241*a* and the first outer end 242*a* are disposed on the same side, and the second inner end 241*b* and the second outer end 242*b* are disposed on the same side. The first inner end 241*a* and the first outer end 242*a* are movably connected to the base plate 20, the second inner end 241*b* is movably connected to the first connecting part 1011, and the second outer end 242*b* is movably connected to the second connecting part 1012.

The first connecting part 1011 comprises two first connectors 10111 separately disposed. Each of the first connectors 10111 comprises a connecting hole 10112 and a receiving hole 10113. The connecting hole 10112 and the receiving hole 10113 penetrate two opposite side surfaces of the first connector 10111. The receiving hole 10113 is communicating with the connecting hole 10112 and penetrates a surface of the first connector 10111 away from the inner body 101. The centers of the two connecting holes 10112 of the two first connectors 10111 are on the same line.

The second connecting part 1012 comprises two second connectors 10121 oppositely disposed. Each of the second connectors 10121 comprises a coupling slot 10122. The opening of the coupling slot 10122 is disposed on a surface of the second connector 10121 away from the first connecting part 1011 and a surface opposite to another second connector 10121. The coupling slot 10122 extends from the surface of the second connector 10121 away from the first connecting part 1011 in a direction closing to the first connecting part 1011.

When the supporting component 24 is mounted on the keycap 1, a second inner end 241*b* of an inner member 241 of the supporting component 24 enters the two connecting holes 10112 through the two receiving holes 10113 of the first connecting part 1011 and is movably connected to the two connecting holes 10112. In this embodiment, the width between the two opposite sidewalls of the receiving hole 10113 is narrower than the inner diameter of the connecting hole 10112. The receiving hole 10113 could have the second movable end 241*b* of the inner member 241 to be restricted in the connecting hole 10112 to prevent the second movable end 241*b* of the inner movable part 241 from being detached from the connecting hole 10112. A second outer end 242*b* of an outer member 242 of the supporting component 24 could slide into the two coupling slots 10122 of the second connecting part 1012.

The inner body 101 of the inner keycap member 10 of this embodiment comprises a limitation structure 1013. The limitation structure 1013 is disposed on the first inner surface 10*a* of the inner body 101 and is disposed on one side of the first connecting part 1011. That is, the limitation structure 1013 is further from the second connecting part 1012 than the first connecting part 1011. A gap exists between the limitation structure 1013 and the first connecting part 1011. The limitation structure 1013 is, for example, configured as a stopper for a spraying jig (not shown) of the corresponding keycap 1 for positioning. When the keycap 1 can be detachably secured to the spraying jig through the engaging part of the jig such as the limit part 1013. The limitation structure 1013 could prevent the keycap 1 from affecting the configuration of the first connecting part 1011 and the second connecting part 1012 of the supporting component 24 after the keycap 1 being removed from the spray jig.

In one embodiment, the inner body 101 of the inner keycap member 10 of this embodiment comprises a first spacer 1014 and a second spacer 1015. The first spacer 1014 is disposed between the two first connectors 10111 of the first connecting part 1011, and is disposed corresponding to the second inner end 241*b* of the inner member 241. The second spacer 1015 is disposed between the two second connectors 10121 of the second connecting part 1012 and is disposed corresponding to the second outer end 242*b* of the outer member 242. The first spacer 1014 and the second spacer 1015 respectively comprises at least one partition bump. In this embodiment, the first spacer 1014 comprises a single partition bump, and the second spacer 1015 comprises two partition bumps disposed at intervals. When the supporting component 24 is mounted to the keycap 1, the first spacer 1014 and the second spacer 1015 protrude from the first inner surface 10*a* of the inner body 101. In this way, a gap between the inner member 241 and the inner body 101, or between the outer member 242 and the inner body 101 can be avoided, and the impact between the keycap 1 and the supporting component 24 can be reduced to achieve noise reduction.

In one embodiment, the inner body 101 of the inner keycap member 10 of this embodiment further comprises a third spacer 1016. The third spacer 1016 is disposed on the first inner surface 10*a* of the inner body 101 and is disposed at the relative center of the inner body 101 corresponding to the elastic member 22. The third spacer 1016 can be, for example, a bump protruding from the first inner surface 10*a* of the inner body 101, and can be directly contacting with the elastic member 22. When pressing the keycap 1, the third spacer 1016 abuts the elastic member 22 to deform the elastic member 22 to trigger the corresponding circuit switch.

In one embodiment, the inner body 101 of the inner keycap member 10 of this embodiment further comprises a plurality of niches 1017. The plurality of niches 1017 is disposed on the first inner surface 10*a* of the inner body 101, and are disposed around the third spacer 1016 to correspond to a plurality of bumps 2421 of the outer member 242. When the keycap 1 squeezes the supporting component 24, the plurality of bumps 2421 of the outer member 242 would approach to the inner body 101. Thus, the plurality of bumps 2421 can enter the corresponding niches 1017 to keep the plurality of bumps 2421 of the outer member 242 from contacting with the first inner surface 10*a* of the inner body 101 to prevent the operation of the keycap 1 from being affected.

Figure 8:
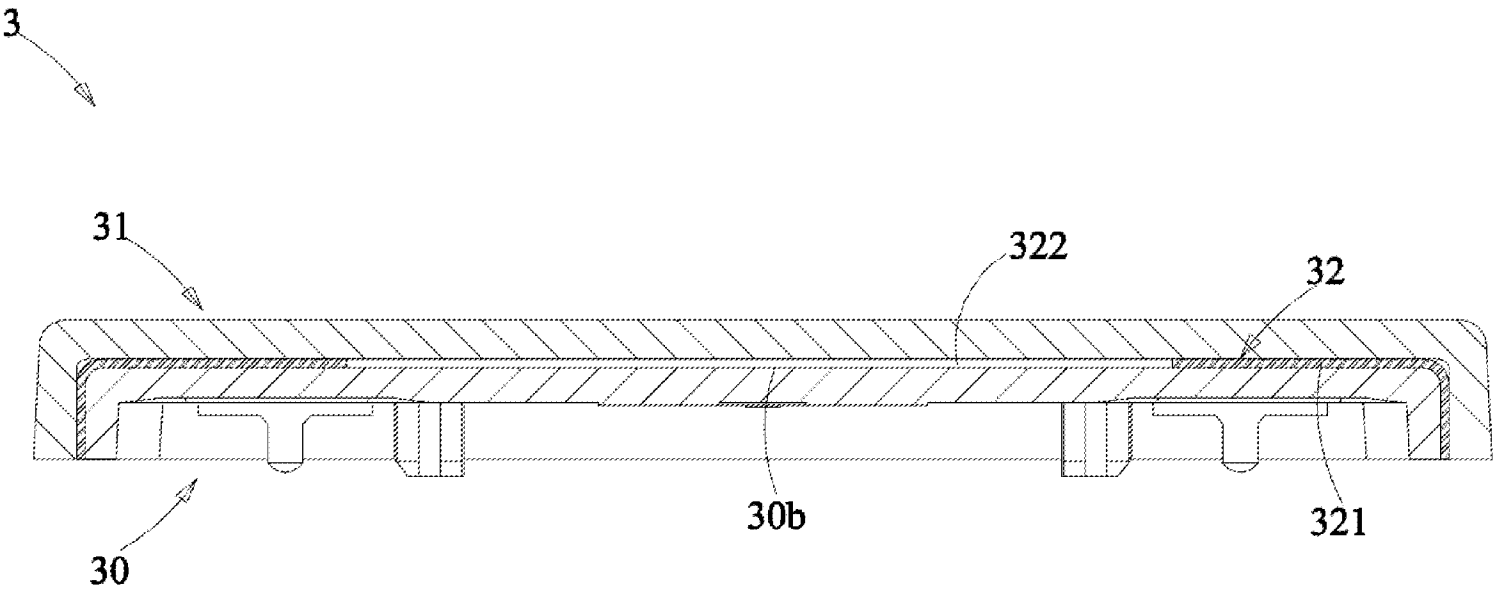
FIG. 8 is a cross-sectional view of a keycap of the second embodiment of the present invention.
Figure 9:
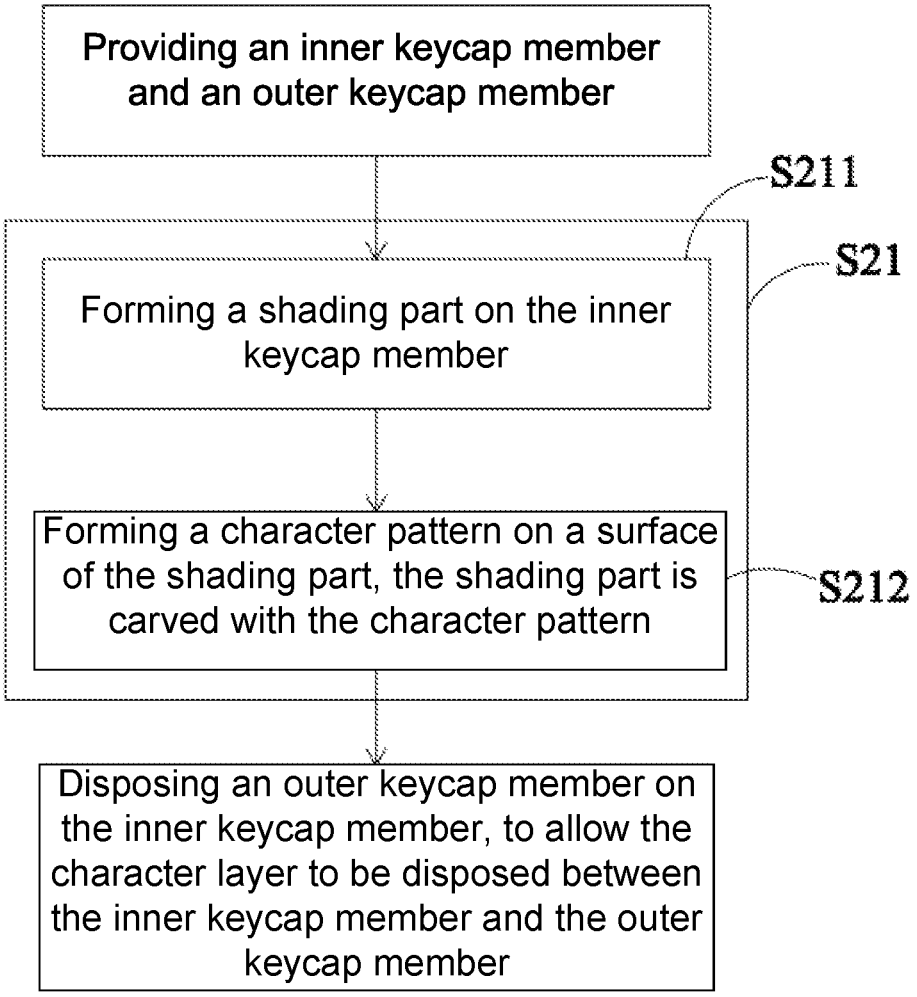
FIG. 9 is a flowchart of the method for manufacturing a keycap of the second embodiment of the present invention.

FIG. 8 is a cross-sectional view of a keycap of the second embodiment of the present invention. FIG. 9 is a flowchart of the method for manufacturing a keycap of the second embodiment of the present invention. As shown in the figure, the keycap 3 of this embodiment is different from the keycap 1 of the first embodiment in that a character pattern 322 of a character layer 32 of the keycap 3 penetrates a shading part 321, indicating that the character pattern 322 is hollow and a first outer surface 30*b* of an inner keycap member 30 is exposed from the character pattern 322. The manufacturing method of the keycap 3 of this embodiment is different from that of the keycap of the first embodiment in the step of the forming of the character layer 32. In step S21 of this embodiment, to form the character layer 32 on the inner keycap member 30, step S211 is first performed to form a shading part 321 on the inner keycap member 30. In this embodiment, the shading part 321 is formed on a first outer surface 30*b* of the inner keycap member 30. Step S212 is then performed to form a character pattern 322 on the shading part 321, wherein the character pattern 322 penetrates the shading part 321. In this embodiment, the step of forming the character pattern 322 is to laser the shading part 321 to form a hollow-type character pattern 322 on the shading part 321, or to directly form a shading part 321 with a hollow-type character pattern 322 by screen printing or inkjet printing.

Figure 10:
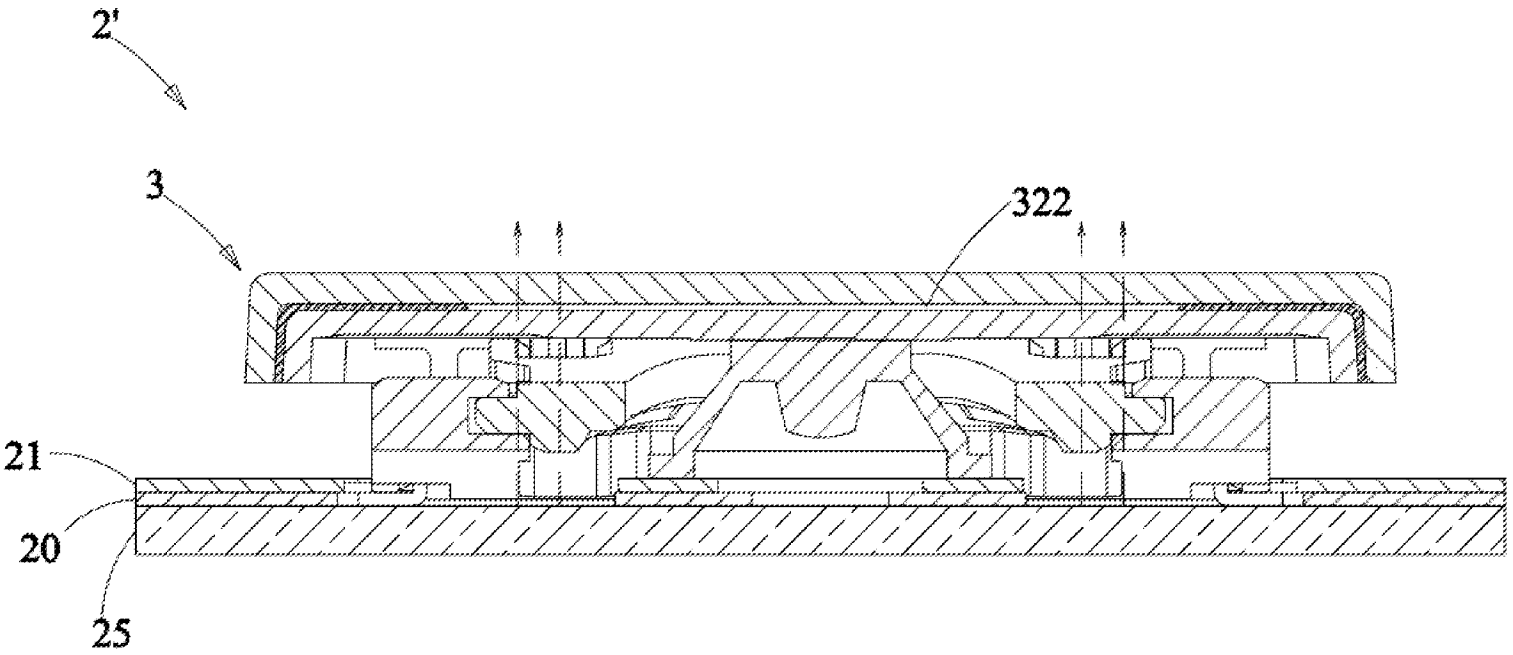
FIG. 10 is a cross-sectional view of a keyswitch of the second embodiment of the present invention.

FIG. 10 is a cross-sectional view of a keyswitch of the second embodiment of the present invention. As shown in the figure, the keyswitch 2' of this embodiment is different from the keyswitch 2 of the first embodiment in that the keyswitch 2' further comprises a backlight module 25, and the keycap 1 is replaced with the keycap 3 of this embodiment. The backlight module 25 is disposed on the base plate 20. In this embodiment, the backlight module 25 is disposed on a surface of the base plate 20 away from the circuit board 21. Since both the base plate 20 and the circuit board 21 of this embodiment have hollow areas, the light emitted from the backlight module 25 could pass through the hollow areas of the base plate 20 and the circuit board 21 and is projected toward the keycap 3. Thus, the light emitted from the backlight module 25 can pass through the character pattern 322 of the keycap 3, so the character pattern 322 on the keycap 3 can be clearly seen and identified. The character layer 32 of this embodiment is disposed between the inner keycap member 30 and the outer keycap member 31 and is protected by the outer keycap member 31. Thus, the wear resistance and reliability of the character layer 32 can be improved and the visual effects of light emitted by the backlight module 25 shown through the character pattern 322 can also be improved.

Figure 11:
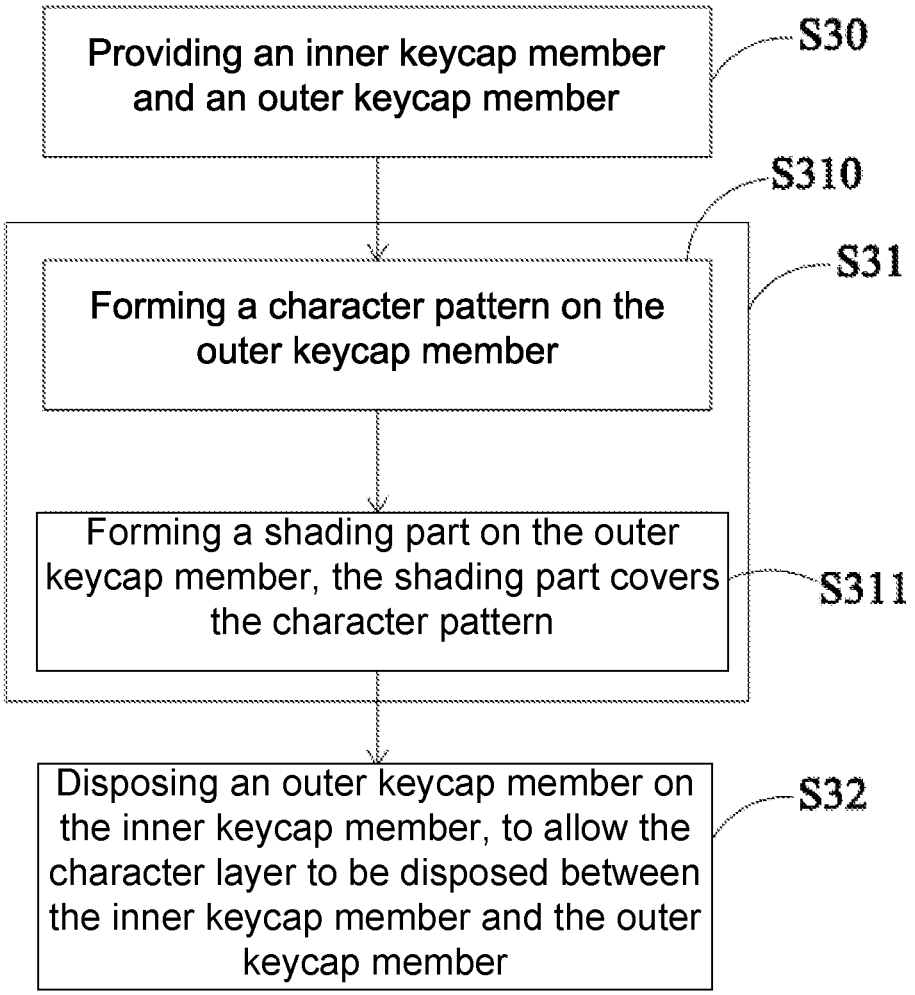
FIG. 11 is a flowchart of the method for manufacturing a keycap of the third embodiment of the present invention.
Figure 12:
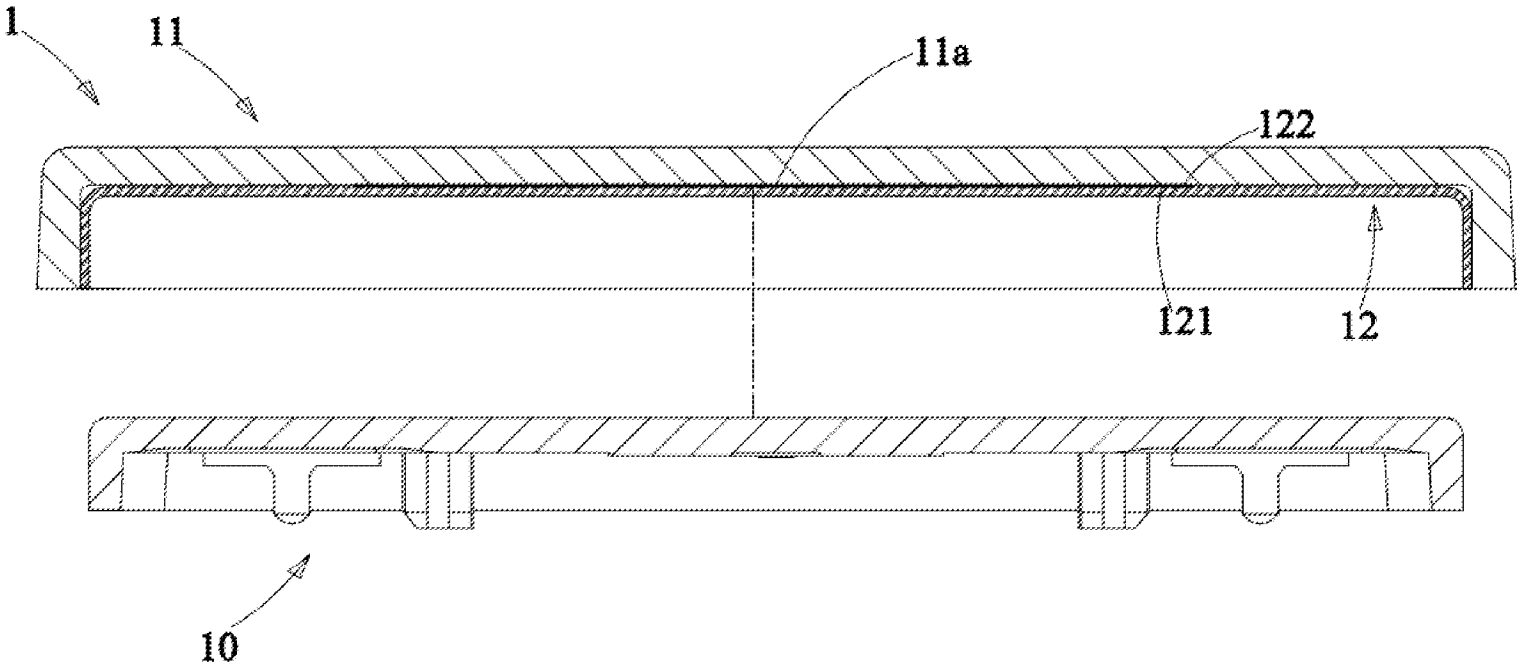
FIG. 12 is a schematic diagram of step S32 of the third embodiment of the present invention.

FIG. 11 is a flowchart of the method for manufacturing a keycap of the third embodiment of the present invention. FIG. 12 is a schematic diagram of step S32 of the third embodiment of the present invention. As shown in the figure, this embodiment provides another method for manufacturing a keycap to manufacture the keycap 1 of the first embodiment (FIG. 2). Firstly to execute step S30 to provide an inner keycap member 10 and an outer keycap member 11. Then, step S31 is performed to form a character layer 12 on the outer keycap member 11. In this embodiment, a character layer 12 is formed on a second inner surface 11*a* of the outer keycap member 11. Finally, execute the step S32 to dispose the outer keycap member 11 on the inner keycap member 10 so that the character layer 12 can be disposed between the inner keycap member 10 and the outer keycap member 11. The method for manufacturing a keycap of this embodiment is different from that of the above embodiment in that the manufacturing method of the keycap of this embodiment is first to form the character layer 12 on the outer keycap member 11, then assemble the outer keycap member 11 having the character layer 12 with the inner keycap member 10. Wherein the step S31 is mainly depending on whether the keycap is used for keyswitches with or without a backlight module. The keycap 1 of the first embodiment is, for example, a keyswitch for a module without a backlight. Since the character pattern 122 of the keycap 1 of the first embodiment is formed on a surface of the shading part 121 close to the outer keycap member 11, the step S31 of this embodiment first to perform step S310 to form a character pattern 122 on the outer keycap member 11. In this embodiment, the character pattern 122 is formed on a second inner surface 11*a* of the outer keycap member 11, which is formed by printing. Then, a shading part 121 is formed in the following step S311 on the outer keycap member 11, covering the character pattern 122. That is, the shading part 121 is formed on the second inner surface 11*a* of the outer keycap member 11. Thus, the character pattern 122 would be disposed on a surface of the shading part 121 close to the outer keycap member 11.

Figure 13:
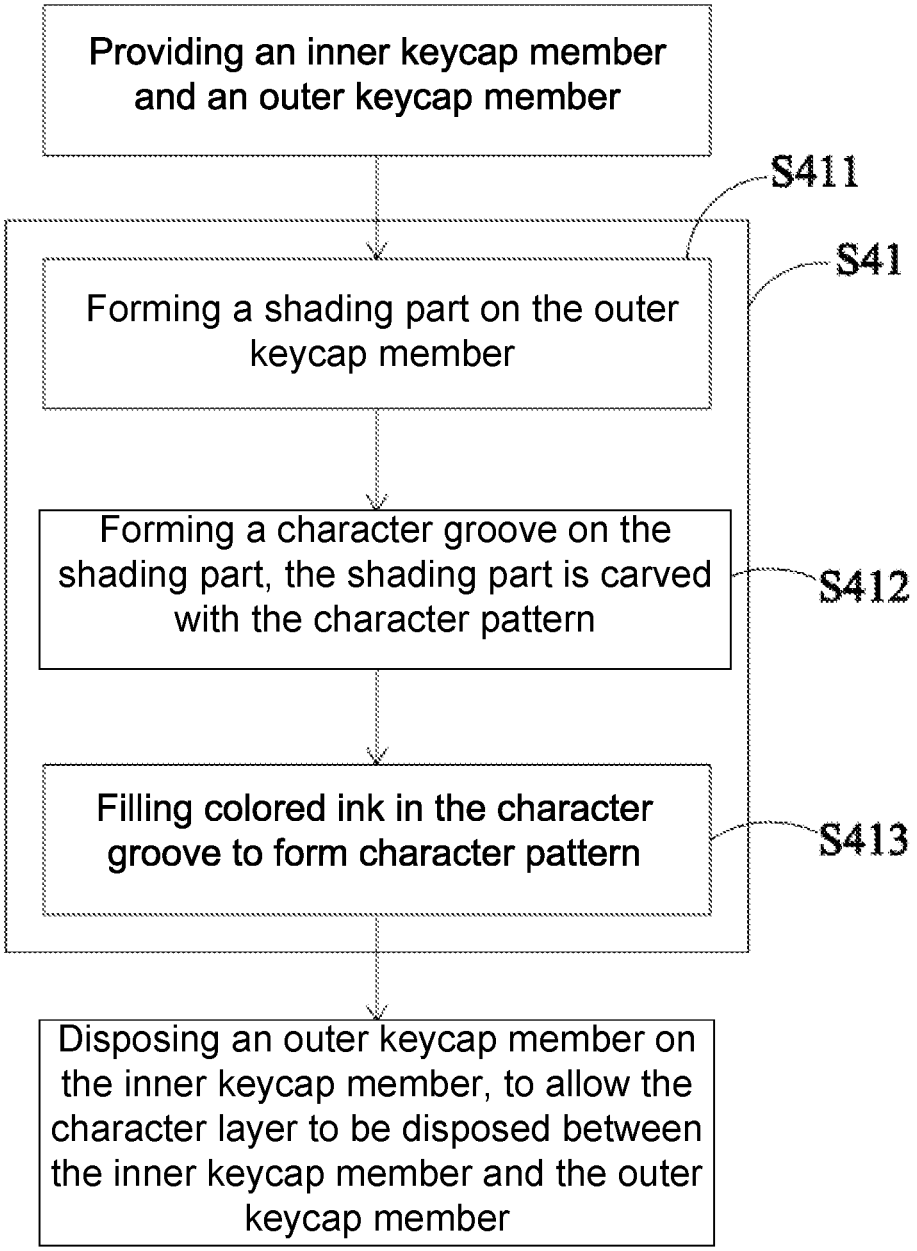
FIG. 13 is a flowchart of the method for manufacturing a keycap of the fourth embodiment of the present invention.

FIG. 13 is a flowchart of the method for manufacturing a keycap of the fourth embodiment of the present invention. As shown in the figure, characters of the character layer in the keycap 1 of the first embodiment can be formed by first forming a character groove on the shading part, then filling the character groove with colored ink. The method for manufacturing a keycap of this embodiment is different from that of the third embodiment in the way of forming the character layer. In this embodiment, the step of forming the character layer (step S41) is to first perform step S411 to form a shading part on the outer keycap member, i.e., forming a shading part on the second inner surface of the outer keycap member. Then, perform step S412 to form a character groove in the shading part, wherein the character groove penetrates the shading part. In this embodiment, the step of forming a character groove on the shading part is, to laser the shading part to form a character groove thereon. Finally, step S413 is performed to fill the character groove with colored ink to form character.

Figure 14:
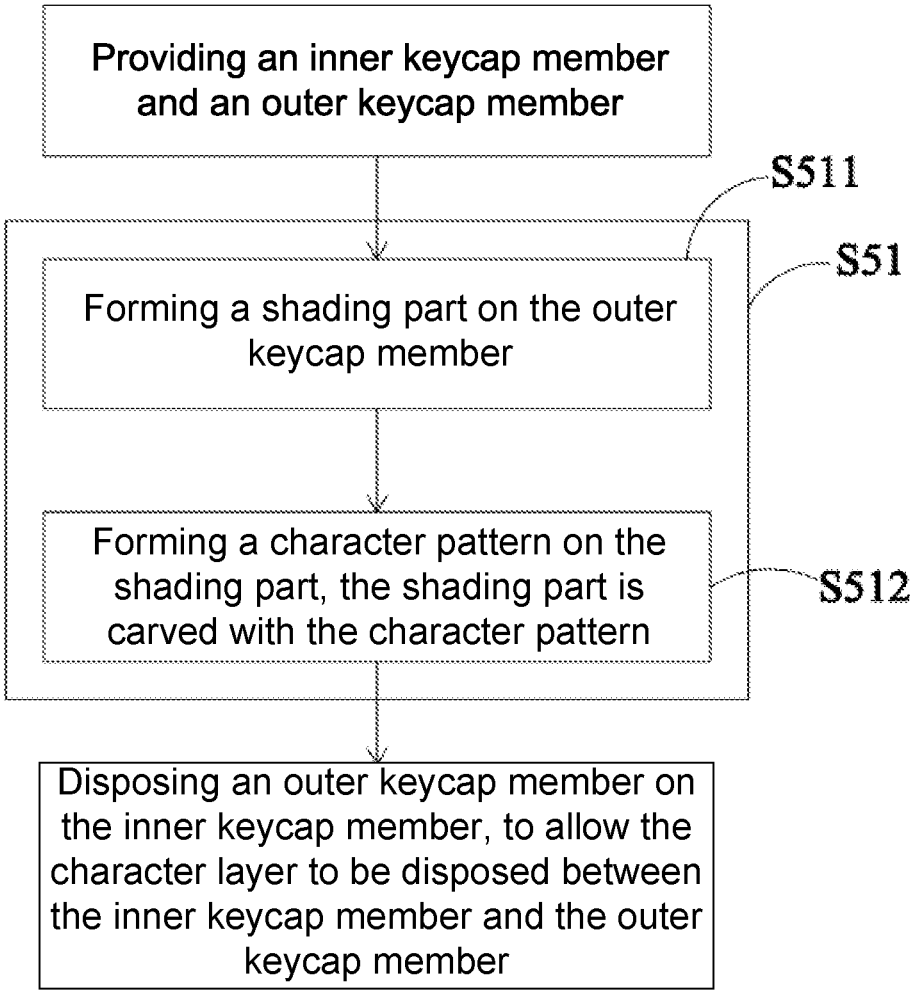
FIG. 14 is a flowchart of the method for manufacturing a keycap of the fifth embodiment of the present invention.

FIG. 14 is a flowchart of the method for manufacturing a keycap of the fifth embodiment of the present invention. As shown in the figure, the keycap manufactured by the manufacturing method of this embodiment is shown as the keycap 3 of the second embodiment (see FIG. 9), which is used for the keyswitches having backlight modules. Although the method for manufacturing a keycap of this embodiment is different from that of the second embodiment, the steps of manufacturing are pretty much the same as the method for manufacturing a keycap of the third embodiment. The method for manufacturing a keycap of this embodiment is different from that of the third embodiment in the step of forming the character layer 32 (step S51). In this embodiment, to form a character layer 32 is to first execute step S511 to form a shading part 321 on the outer keycap cover 31, i.e., forming the shading part 321 on a second inner surface 31*a* of the outer keycap member 31. Then, step S512 is performed to form a character pattern 322 on the shading part 321, wherein the character pattern 322 penetrates the shading part 321. In this embodiment, the step of forming the character pattern 322 is to laser the shading part 321 to form the character pattern 322 on the shading part 321.

Figure 15:
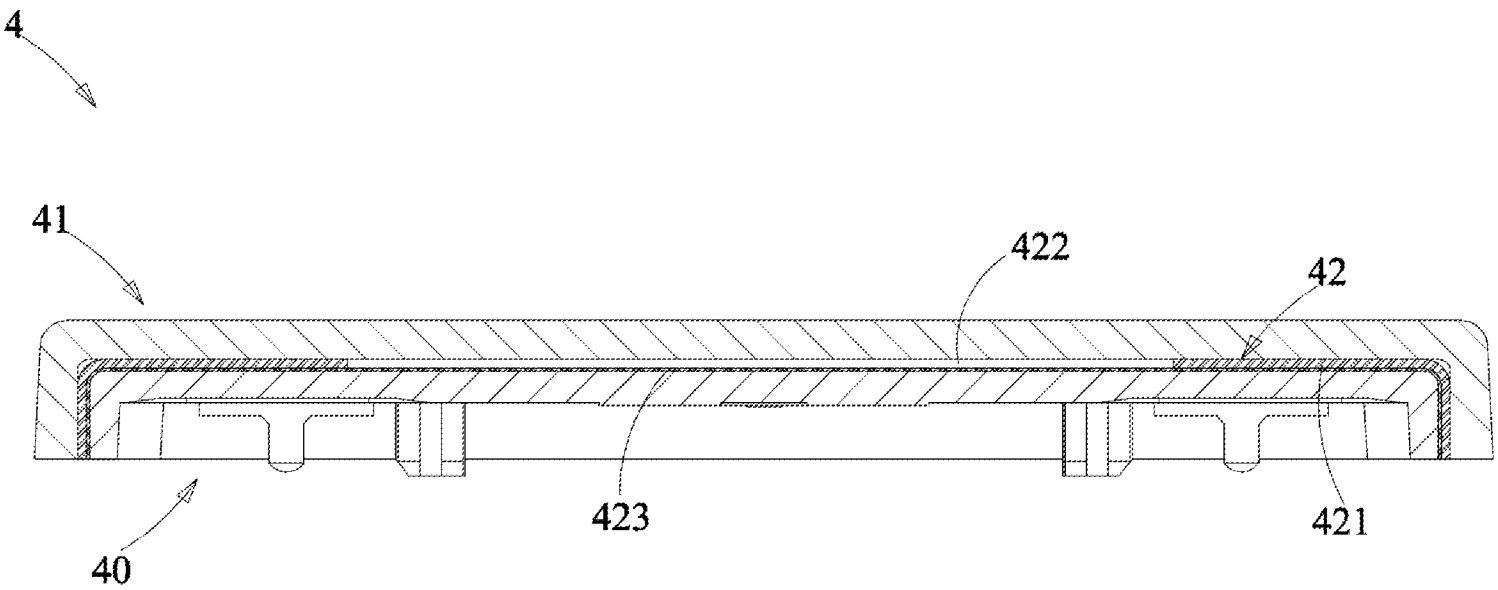
FIG. 15 is a cross-sectional view of a keycap of the sixth embodiment of the present invention.
Figure 16:
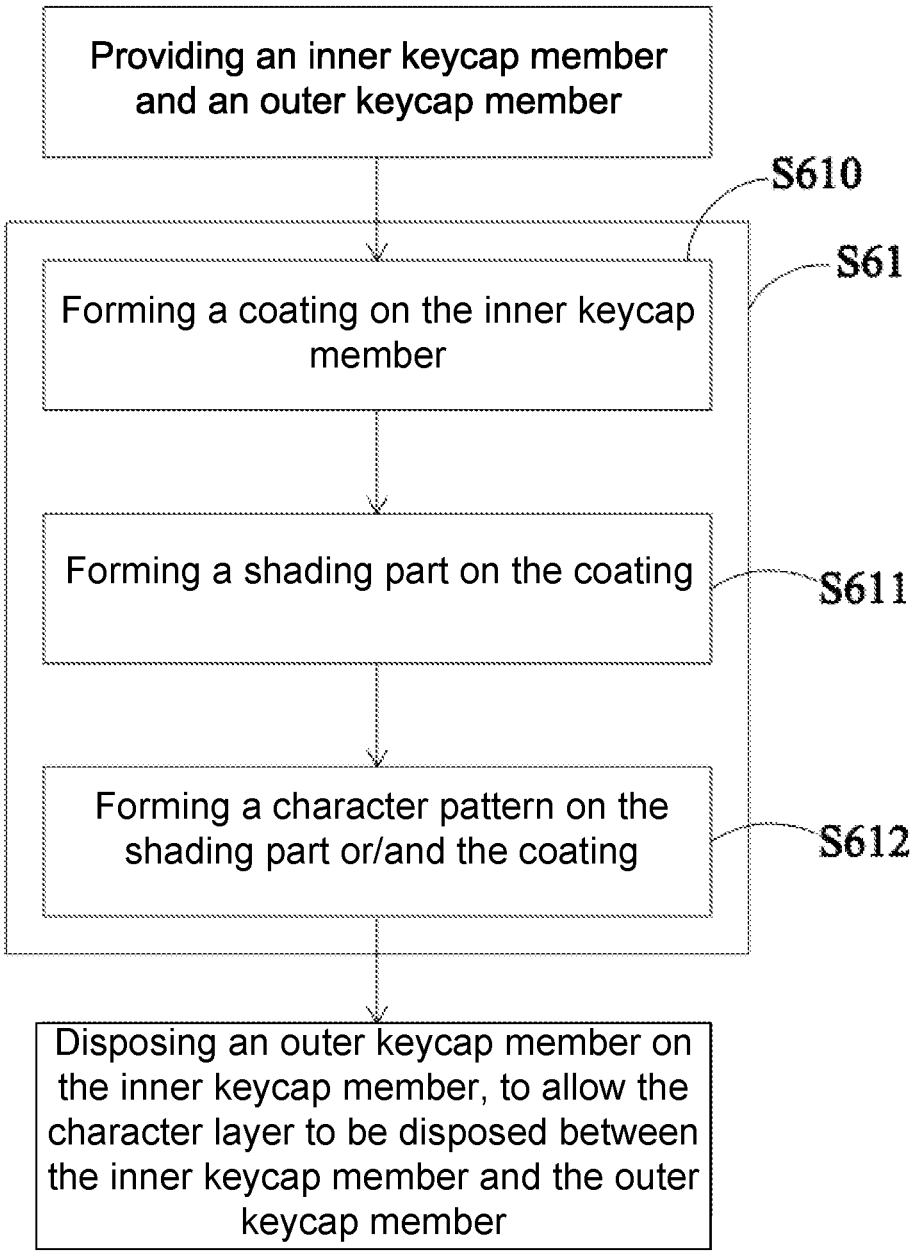
FIG. 16 is a flowchart of the method for manufacturing a keycap of the sixth embodiment of the present invention.

FIG. 15 is a cross-sectional view of a keycap of the sixth embodiment of the present invention. FIG. 16 is a flowchart of the method for manufacturing a keycap of the sixth embodiment of the present invention. As shown in the figure, the keycap 4 of this embodiment is a keycap paint in tint. The tint keycap indicates that the color of the character layer 42 is, such as white, pink, light blue, or light gray. The keycap 4 of this embodiment is different from the keycap 3 of the above embodiment in that the character layer 42 of this embodiment further including a coating 423. The coating 423 is disposed between a shading part 421 and an inner keycap member 40. Wherein the coating 423 and the shading part 421 are paint in tint, the coating 423 is transparent, and the shading part 421 is opaque. When the keycap 4 of this embodiment is used for a keyswitch having a backlight module, the coating 423 would first reduce the intensity of the light emitted by the backlight module, and the shading part 421 could shield the light which is not transmitted from the hollowed character pattern 422, allowing the character pattern 422 on the keycap 4 to be more clearly seen from the outside of the keyswitch.

The manufacturing method of the keycap of this embodiment is similar as that of the second embodiment, the difference only lies in the step of forming the character layer 42 (step S61). In this embodiment, in step S61, step S620 is performed first to form a coating 423 on the inner keycap member 40, and then step S611 is performed to form a shading part 421 on the coating 423. Finally, step S612 is performed to form a character pattern 422 on the shading part 421 or/and on the coating 423, wherein the step of forming character pattern 422 on the shading part 421 or/and on the coating 423 refers to that the character pattern 422 only penetrates the shading part 421 to form a hollow character pattern 422 on the shading part 421, or the character pattern 422 penetrates the shading part 421 and a part of the coating 423 to form a hollow character pattern 422 on the shading part 421 and the coating 423, or the character pattern 422 penetrates the shading part 421 and the coating 423 to form a hollow character pattern 422 on the shading part 421 and the coating 423. In this embodiment, the character pattern 422 only penetrates the shading part 421. In this embodiment, the step of forming the character pattern 422 is to laser the shading part 421 to form a hollow character pattern 422 on the shading part 421 or/and on the coating 423.

Figure 17:
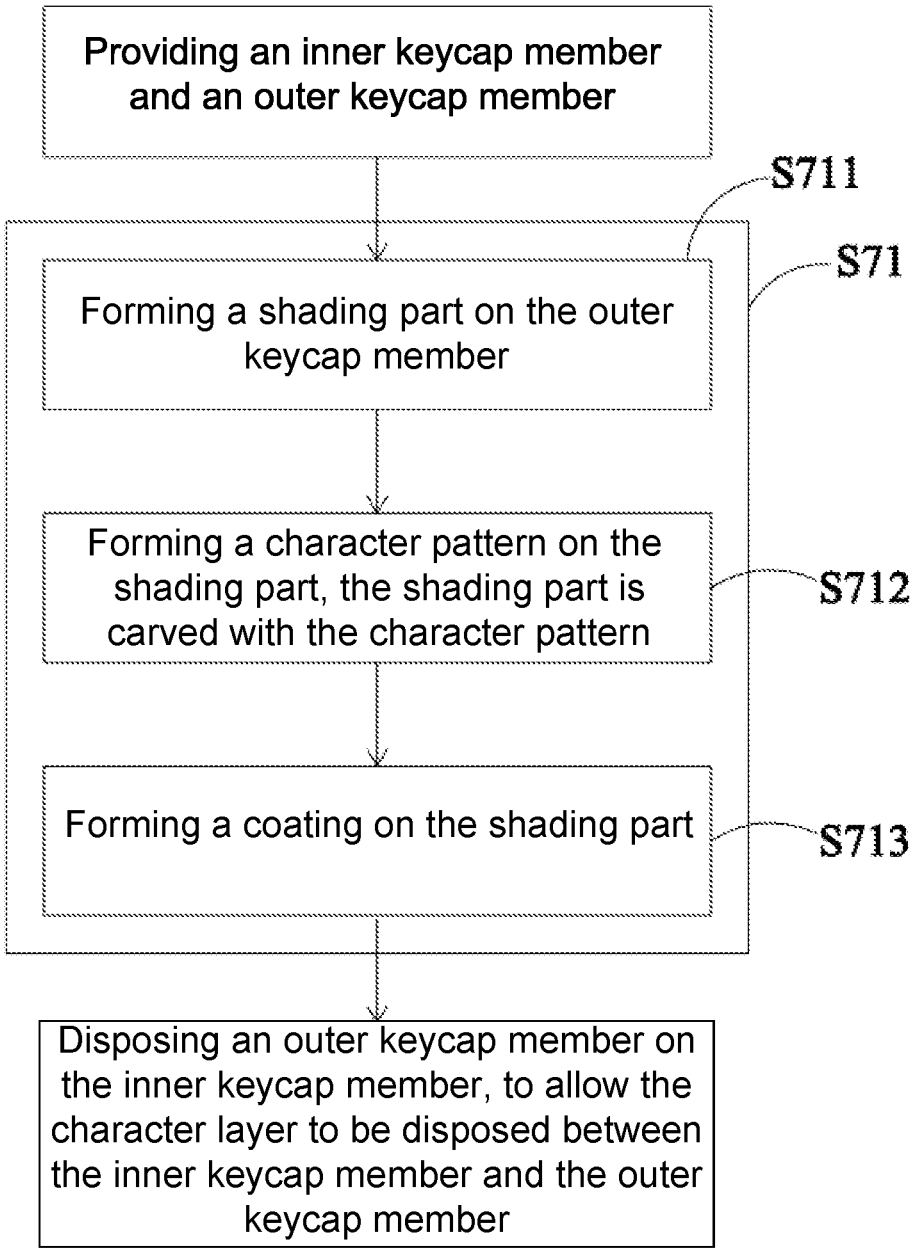
FIG. 17 is a flowchart of the method for manufacturing a keycap of the seventh embodiment of the present invention.

FIG. 17 is a flowchart of the method for manufacturing a keycap of the seventh embodiment of the present invention. As shown in the figure, this embodiment provides another method for manufacturing a keycap for manufacturing the keycap 4 of the sixth embodiment (see FIG. 15). The manufacturing method of the keycap of this embodiment is different from that of the keycap of the sixth embodiment. The manufacturing method of the keycap of this embodiment mainly applies the manufacturing method of the keycap of the fifth embodiment. The method for manufacturing a keycap of this embodiment is different from that of the fifth embodiment in the step of forming the character layer 42 (step S71). In this embodiment, the step S71 is to first perform step S711 to form the shading part 421 on the outer keycap member 41, and then perform step S712 to form a character pattern 422 on the shading part 421, wherein the character pattern 422 penetrates the shading part 421. The step of forming the character pattern 422 is to laser the shading part 421 to form a hollow character pattern 422 on the shading part 421. Finally, step S713 is performed to form a coating 423 on the shading part 421, wherein the coating 423 of this embodiment is transparent. When the keycap 4 of this embodiment is used for a keyswitch with a backlight module, by which the light emitted can pass through the coating 423 and goes out from the hollowed character pattern 422.

Figure 18:
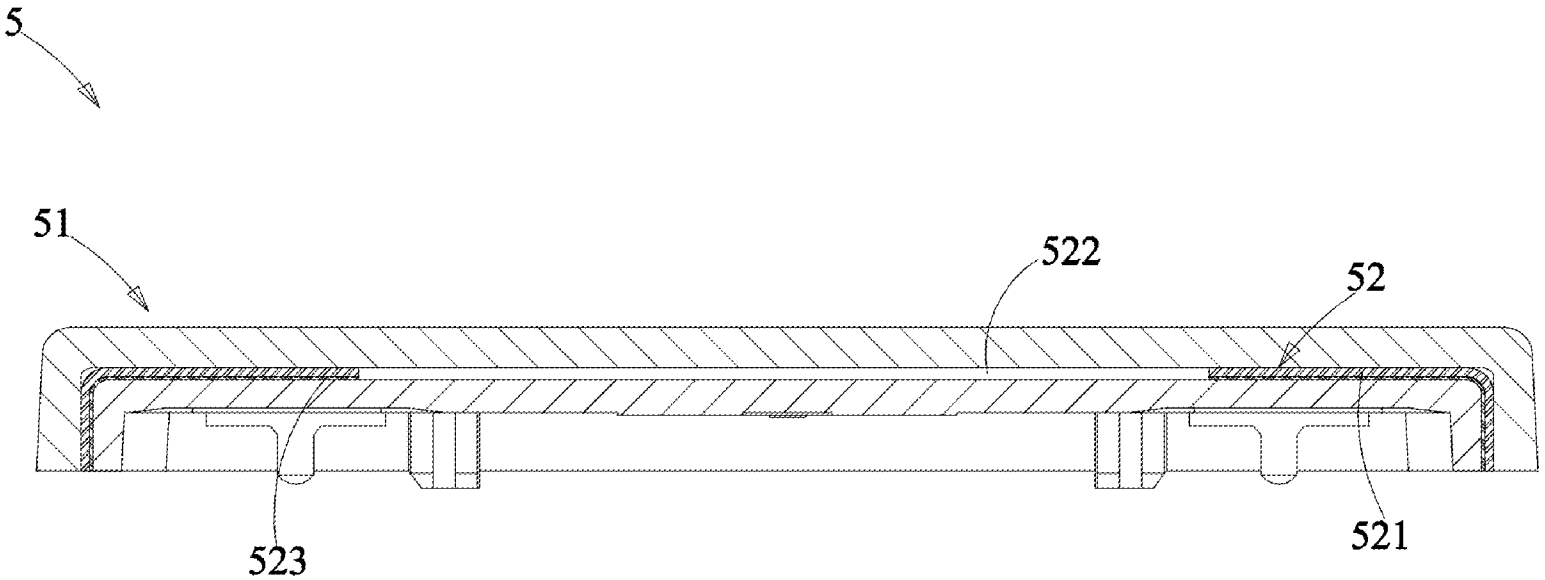
FIG. 18 is a cross sectional view of a keycap of the eighth embodiment of the present invention.
Figure 19:
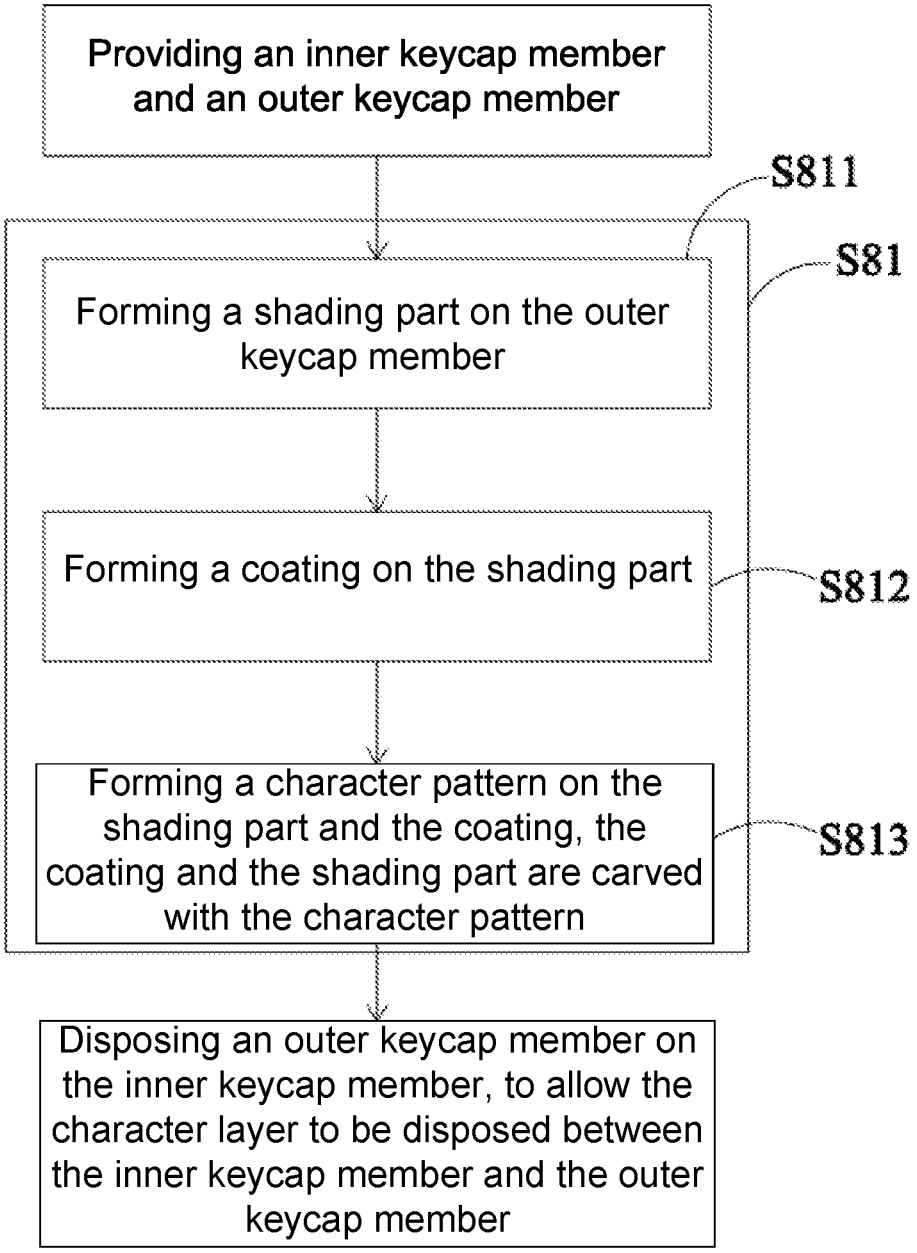
FIG. 19 is a flowchart of the method for manufacturing a keycap of the eighth embodiment of the present invention.

FIG. 18 is a cross-sectional view of a keycap of the eighth embodiment of the present invention. FIG. 19 is a flowchart of the method for manufacturing a keycap of the eighth embodiment of the present invention. As shown in the figure, the keycap 5 of this embodiment is different from the keycap 4 of the sixth embodiment in that the character pattern 522 of the character layer 52 of this embodiment penetrates the shading part 521 and the coating 523. The method for manufacturing a keycap of this embodiment is different from that of the seventh embodiment in the step of forming the character layer 52 (step S81). In this embodiment, step S81 is to first perform step S811 to form the shading part 521 on the outer keycap member 51, and then perform step S812 to form a coating 523 on the shading part 521. Finally, step S813 is performed to form a character pattern 522 on the coating 523 and the shading part 521, wherein the character pattern 522 penetrates the coating 523 and the shading part 521. The step of forming the character pattern 522 refers to laser the shading part 521 and the coating 523 to form a hollow character pattern 522 on the shading part 521 and the coating 523. When the keycap 5 of this embodiment is used for a keyswitch having a backlight module, the light emitted by the backlight module could directly go out from the hollow character pattern 522. At this time, the light transmitted from the hollow character pattern 522 is relatively intense, displaying the character pattern 522 clearly on the keycap 5.

Figure 20:
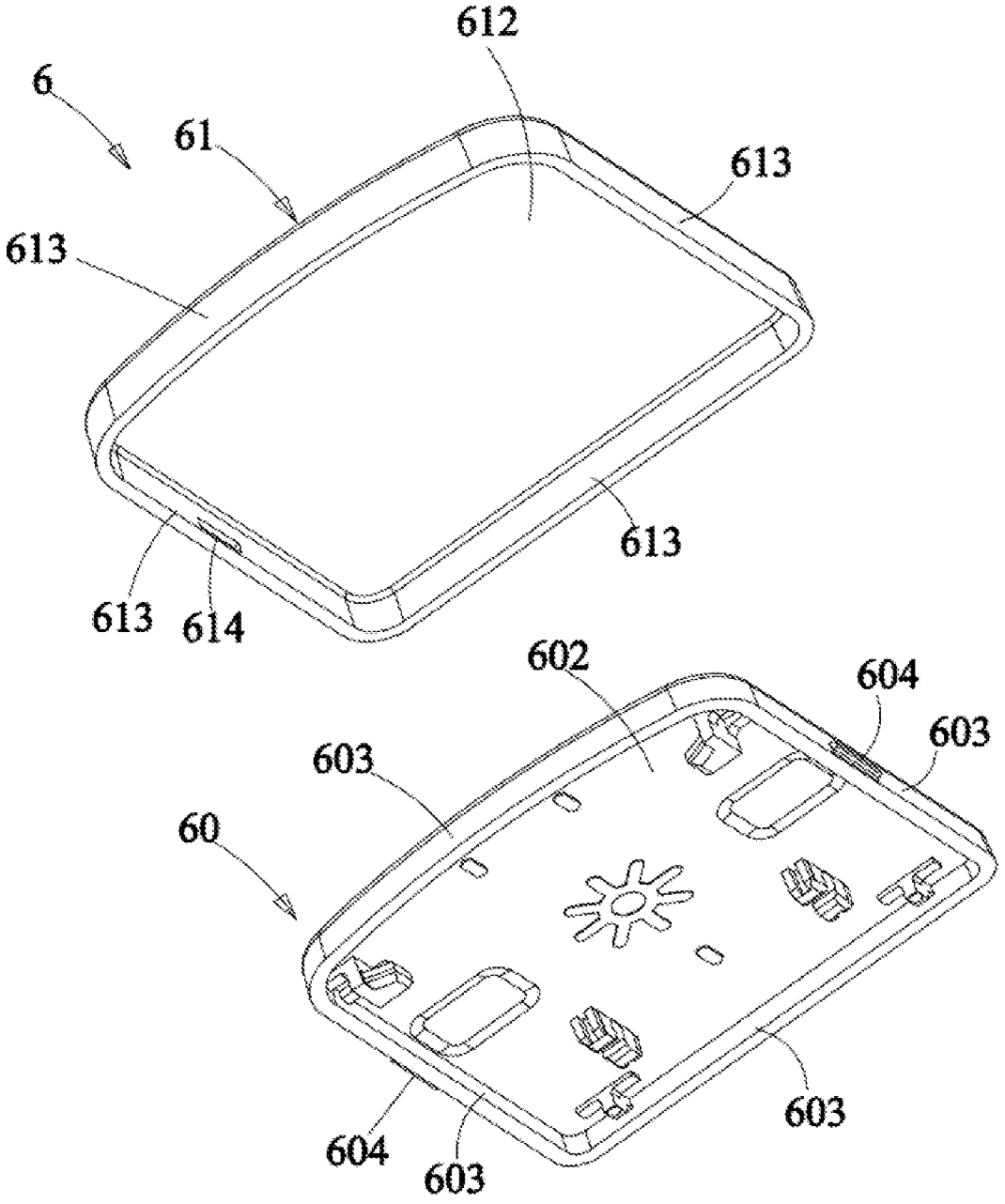
FIG. 20 is am exploded view of a keycap of the ninth embodiment of the present invention.
Figure 21:
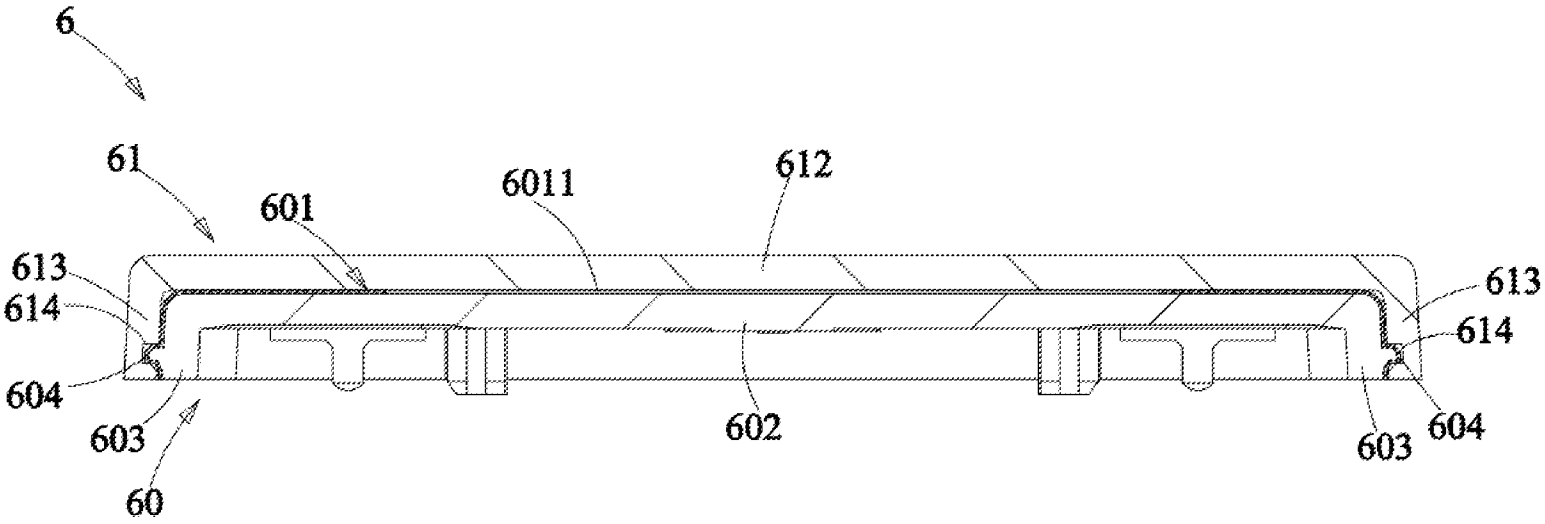
FIG. 21 is a cross sectional view of a keycap of the ninth embodiment of the present invention.

FIG. 20 is an exploded view of a keycap of the ninth embodiment of the present invention. FIG. 21 is a cross-sectional view of a keycap of the ninth embodiment of the present invention. As shown in the figure, the keycap 6 of this embodiment comprises an inner keycap member 60 and an outer keycap member 61 disposed on the inner keycap member 60. The surface where the inner keycap member 60 connected to the outer keycap member 61 is provided with a character layer 601 comprising a character pattern 6011. The inner keycap member 60 comprises an inner body 602 and four inner sidewalls 603 disposed on four sides of the inner body 602, two ends of each of the inner sidewalls 603 are connected to other inner sidewalls. The outer keycap member 61 comprises an outer body 612 and four outer sidewalls 613 disposed on four sides of the outer body 612, two ends of each of the outer sidewalls 613 are connected to other outer sidewalls.

When the outer keycap member 61 is disposed on the inner keycap member 60, the outer body 612 corresponds to the inner body 602. The four outer sidewalls 613 correspond to the four inner sidewalls 603 so that the outer keycap member 61 is sleeved on an outer surface of the inner keycap member 60. The surface where the inner body 602 connects to the outer body 612 and the surfaces where the four inner sidewalls 603 connects to the four outer sidewalls 613 are respectively provided with a character layer 601. In other words, the character layer 601 is distributed on the inner body 602 and the four inner sidewalls 603, and the character pattern 6011 is disposed on the inner body 602. For the manufacture of the inner keycap member 60 of this embodiment, please refer to step S11 in the method of manufacturing the keycap of the first embodiment and step S21 in the method of manufacturing the keycap of the second embodiment of step S61 in the method for manufacturing a keycap of the sixth embodiment, which would not be repeated again herein.

In this embodiment, the outer surfaces of the two opposite inner sidewalls 603 of the four inner sidewalls 603 are respectively provided with an inner keycap positioning part 604. The inner surfaces of the two opposite outer sidewalls 613 of the four outer sidewalls 613 are respectively provided with an outer keycap positioning part 614. When the outer keycap member 61 is disposed on the inner keycap member 60, each of the inner keycap positioning parts 604 is disposed on the corresponding outer keycap positioning part 614 to secure the outer keycap member 61 onto the inner keycap member 60. In this embodiment, the internal keycap positioning part 604 is a bump, and the outer keycap positioning part 614 is a recess. Since the above internal keycap positioning part 604 and outer keycap positioning part 614 are only an embodiment of this invention, an internal keycap positioning part 604 can be provided on the outer surface of at least one of the four internal keycap sidewalls 603. It is possible to dispose an outer keycap positioning part 614 on the inner surface of at least one of the four outer sidewalls 613, wherein the number of the inner keycap positioning part 604 corresponds to the number of the outer keycap positioning part 614.

Figure 22:
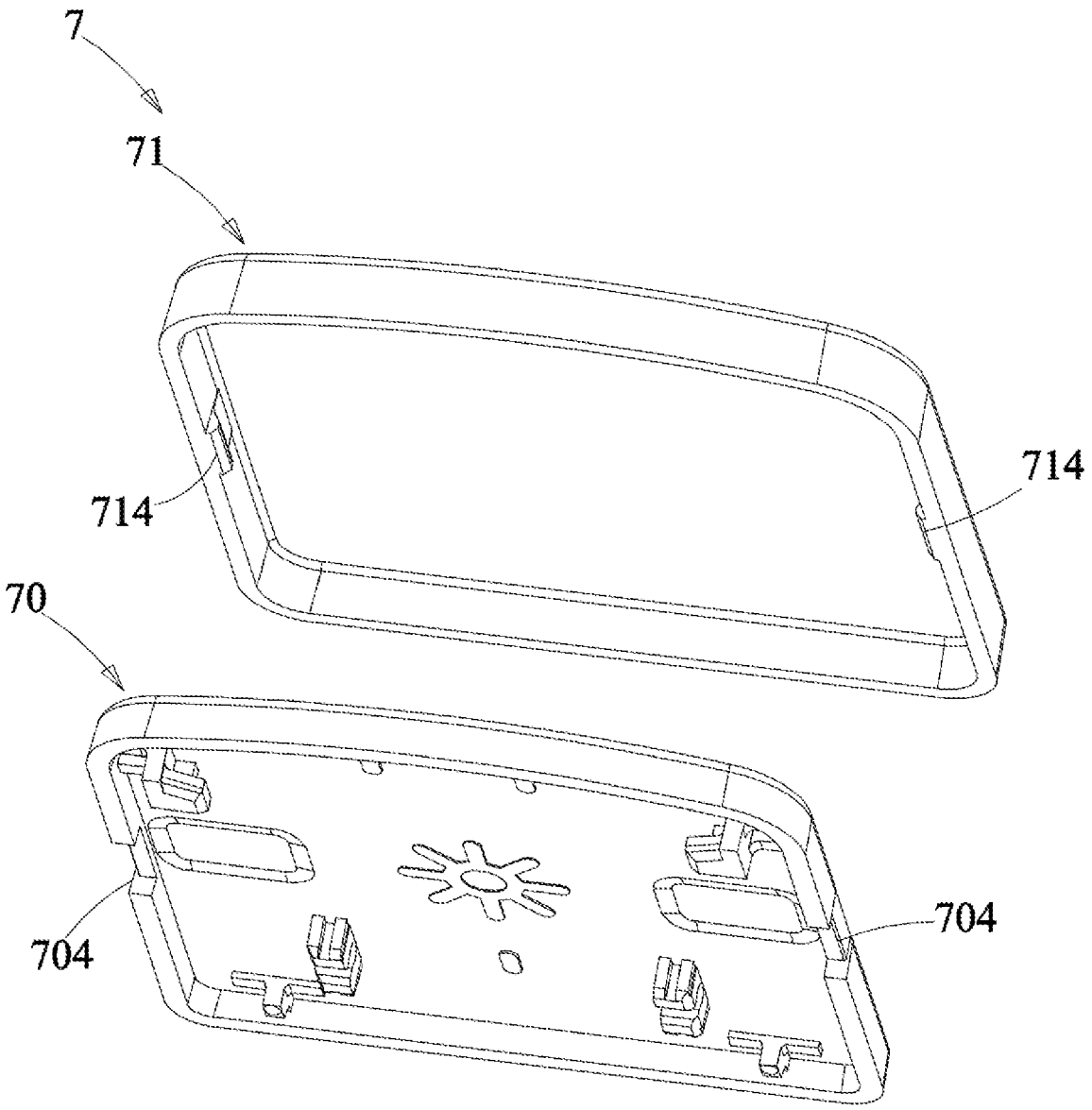
FIG. 22 is a cross sectional view of a keycap of the tenth embodiment of the present invention.

FIG. 22 is a cross-sectional view of a keycap of the tenth embodiment of the present invention. As shown in the figure, the keycap 7 of this embodiment is similar to the keycap 6 of the ninth embodiment, the difference lies in the configuration of the positioning part. In this embodiment, the inner keycap positioning part 704 of the inner keycap member 70 of the keycap 7 is a recess, and the outer keycap positioning part 714 of the outer keycap member 71 is a bump. When the outer keycap member 71 is sleeved on the inner keycap member 70, the outer keycap positioning part 714 can be engaged in the corresponding inner keycap positioning part 704. In other words, the engagement of the outer keycap positioning part 714 and the inner keycap positioning part 704 of this embodiment is a male-female engagement.

It is noted that the ninth and tenth embodiment of the present invention are described in the manner in which the outer keycap member and the inner keycap member are connected by the outer keycap positioning part and the inner keycap positioning part can be used for the keycap described in any of the above embodiments. The following would describe one of the keycap configurations, but would not be limited thereto.

Figure 23:
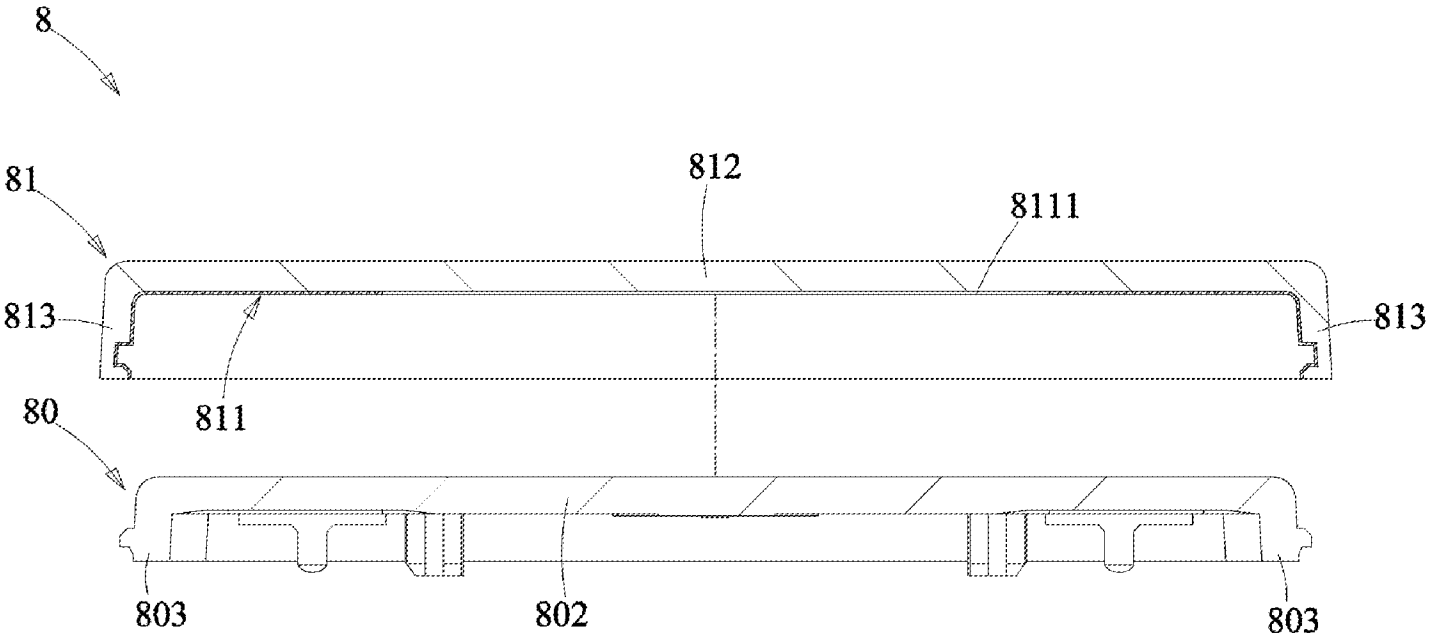
FIG. 23 is an exploded cross sectional view of a keycap of the eleventh embodiment of the present invention.

FIG. 23 is an exploded cross-sectional view of a keycap of the eleventh embodiment of the present invention.

As shown in the figure, the keycap 8 of this embodiment is different from the keycap 6 of the ninth embodiment in that the inner keycap member 80 of the keycap 8 does not comprise a character layer, and on a surface where the outer keycap member 81 and the inner keycap member 80 are connected is provided with a character layer 811. The character layer 811 is disposed on a surface where the outer body 812 of the outer keycap member 81 and the inner body 802 are connected, and on a surface where the four outer sidewalls 813 and the four inner sidewalls 803 are engaged respectively. The character layer 811 comprises a character pattern 8111 on the outer character keycap body 812. The manufacture of the outer keycap member 81 of this embodiment can be referred to step S21 in the method for manufacturing a keycap of the third embodiment, step S41 in the method for manufacturing a keycap of the fourth embodiment, step S51 in the method for manufacturing a keycap of the fifth embodiment, step S71 in the method for manufacturing a keycap of the seventh embodiment, or step S81 in the method for manufacturing a keycap of the fourth embodiment, which would not be described herein again.

The present invention further provides a keyboard, which applies the keyswitches of the first or second embodiment. The keycap of the keyswitch could apply one of the keycaps of the first to eleventh embodiments.

In summary, the present invention proposed a keycap, method for manufacturing a keycap, and keyswitch. By disposing the character layer between the inner keycap member and the outer keycap member, the character layer could avoid being touched by users to improve wear resistance and reliability of the character layer. In addition, the character layer can be single-layer paint or double-layer paint, which reduces the number of paint layers for the character layer and simplifies the manufacturing process of the character layer. Therefore, the production efficiency and production yield of the keycap can be greatly improved.

It is to be understood that the term "comprises", "comprising", or any other variants thereof, is intended to encompass a non-exclusive inclusion, such that a process, method, article, or device of a series of elements not only include those elements but also comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. A keycap, comprising:

an inner keycap member comprising an inner body and an inner sidewall, the inner sidewall being disposed on the periphery of the inner body and protruding from a surface of the inner body; and an outer keycap member disposed on the inner keycap member, the outer keycap member comprising an outer body and an outer sidewall, the outer sidewall being disposed on the periphery of the outer body and covering a surface of the inner sidewall;

wherein the outer keycap member is provided with a recess depressed from an inner surface of the outer keycap member, and the inner keycap member is provided with a protrusion projecting from an outer surface of the inner keycap member corresponding to the inner surface of the outer keycap member and extending into the recess;

wherein the recess is depressed from an inner surface of the outer sidewall, and the protrusion projects from an outer surface of the inner sidewall corresponding to the inner surface of the outer sidewall.

2. The keycap according to claim 1, further comprising a character layer between the inner keycap member and the outer keycap member, and the character layer comprising a character pattern between the outer body and the inner body, wherein the character layer does not extend outside an edge of the inner sidewall.

3. The keycap according to claim 2, wherein the character layer is disposed on the inner body and the inner sidewall.

4. The keycap according to claim 2, wherein the inner keycap member and the outer keycap member are translucent; the character layer comprises a shading part disposed between the outer body and the inner body.

5. The keycap according to claim 4, wherein the character pattern is disposed on a surface of the shading part.

6. The keycap according to claim 4, wherein the shading part is carved with the character pattern.

7. The keycap according to claim 4, wherein the character layer further comprises a coating disposed between the shading part and the inner keycap member.

8. The keycap according to claim 1, wherein the inner body comprises a first connecting part comprising two separate first connectors; each of the first connectors comprises a connecting hole and a receiving hole communicating with the connecting hole; a width of the two opposite sidewalls of the receiving hole is less than an inner diameter of the connecting hole; the two connecting holes of the two first connectors are aligned with the same line.

9. The keycap according to claim 8, wherein the inner body comprises a second connecting part opposite to the first connecting part; the second connecting part comprises two separate second connectors; each of the second connectors comprises a coupling slot having an opening facing the inner sidewall away from the first connecting part.

10. The keycap according to claim 9, wherein the inner body comprises:

a first spacer disposed between the two first connectors;

a second spacer disposed between the two second connectors;

a limitation structure disposed on one side of the first connecting part with a gap exists therebetween;

a third spacer disposed in the center of the inner body; and a plurality of niches disposed on the periphery of the third spacer.

11. The keycap according to claim 1, wherein the inner keycap member comprises at least one inner keycap positioning part; the outer keycap member comprises at least one outer keycap positioning part; the outer keycap positioning part is engaged with the corresponding inner keycap positioning part.

12. A keycap, comprising:

an inner keycap member comprising an inner body and four inner sidewalls disposed on four sides of the inner body and extending downward from the inner body; at least one of the four inner sidewalls having a bottom surface not co-planar with a bottom surface of the inner body, and comprising an inner keycap positioning part; and an outer keycap member comprising an outer body and four outer sidewalls disposed on four sides of the outer body; the outer body being corresponding to the inner body; the four outer sidewalls being corresponding to the four inner sidewalls respectively; at least one of the four outer sidewalls comprising an outer keycap positioning part connecting to the inner keycap positioning part;

wherein the outer keycap member covers the inner keycap member; the inner keycap member or the outer keycap member comprises a character layer with a character pattern, and the character layer does not extend outside edges of the inner sidewalls;

wherein the outer keycap positioning part is a recess, and the inner keycap positioning part is a protrusion extending into the recess;

wherein the recess is depressed from an inner surface of the at least one of the four outer sidewalls, and the protrusion projects from an outer surface of the at least one of the four inner sidewalls corresponding to the inner surface.

13. The keycap according to claim 12, wherein the character layer is disposed on a joining surface where the inner keycap member connects to the outer keycap member.

14. The keycap according to claim 12, wherein the character layer is disposed between the outer body and the inner body; the character layer is further disposed between the four outer sidewalls and the four inner sidewalls.

15. The keycap according to claim 12, wherein the outer keycap positioning part and the inner keycap positioning part are connected by an engagement of a bump and a recess.

16. A keyswitch, comprising:

a base plate;

a circuit board disposed on the base plate;

an elastic member disposed on the circuit board;

a keycap disposed on the elastic member, comprising:

an inner keycap member comprising an inner body and an inner sidewall extending toward the base plate;

an outer keycap member disposed on the inner keycap member and comprising an outer body covering a surface of the inner body and an outer sidewall covering a surface of the inner sidewall; and a character pattern disposed corresponding to the outer body; and a supporting component, having two ends respectively connected to the base plate and the keycap;

wherein the outer keycap member is provided with a recess, and the inner keycap member is provided with a protrusion extending into the recess;

wherein the recess is depressed from an inner surface of the outer sidewall, and the protrusion projects from an outer surface of the inner sidewall corresponding to the inner surface of the outer sidewall.

17. The keyswitch according to claim 16, further comprising a backlight module disposed on a surface of the base plate away from the circuit, wherein light from the backlight module transmits through the character pattern.

18. The keyswitch according to claim 16, further comprising a character layer disposed on an outer surface of the inner keycap member or an inner surface of the outer keycap member, wherein the character layer does not extend outside an edge of the inner sidewall.

19. The keycap according to claim 16, wherein the recess is depressed from an inner surface of the outer keycap member, and the protrusion projects from an outer surface of the inner keycap member corresponding to the inner surface of the outer keycap member.

* * * * *